US011054171B2

(12) United States Patent
Andrus et al.

(10) Patent No.: US 11,054,171 B2
(45) Date of Patent: Jul. 6, 2021

(54) AUTOMATIC HOUSE VENT

(71) Applicants: Daniel George Andrus, Oroville, CA (US); Anthony David Funes, Oroville, CA (US)

(72) Inventors: Daniel George Andrus, Oroville, CA (US); Anthony David Funes, Oroville, CA (US)

( * ) Notice: Subject to any disclaimer, the term of this patent is extended or adjusted under 35 U.S.C. 154(b) by 209 days.

(21) Appl. No.: 16/511,859

(22) Filed: Jul. 15, 2019

(65) Prior Publication Data

US 2021/0018216 A1 Jan. 21, 2021

(51) Int. Cl.
*F24F 13/00* (2006.01)
*F24F 13/14* (2006.01)
*F24F 7/00* (2021.01)

(52) U.S. Cl.
CPC ..... *F24F 13/1426* (2013.01); *F24F 7/00* (2013.01); *F24F 2007/001* (2013.01); *F24F 2013/1433* (2013.01)

(58) Field of Classification Search
CPC ..... F24F 13/1426; F24F 13/1433
See application file for complete search history.

(56) References Cited

U.S. PATENT DOCUMENTS 6,487,057 B1 * 11/2002 Natili ..... H01H 71/123 335/18
2012/0132506 A1 * 5/2012 Potratz ..... H01H 9/20 200/43.11
2014/0083828 A1 * 3/2014 Maloney ..... H01H 9/04 200/304
2014/0176293 A1 * 6/2014 Melecio ..... H01H 71/18 337/12

* cited by examiner

*Primary Examiner* — Vivek K Shirsat
*Assistant Examiner* — Ko-Wei Lin
(74) *Attorney, Agent, or Firm* — Craig A. Simmermon

(57) ABSTRACT

Automatic house vent is a house vent system that automatically closes all house vents when electrical power is shut off to the house. Automatic house vent is a fire prevention mechanism that closes all house vents in order to prevent burning ambers from entering the house through a house vent and starting a fire from the inside of the house. It is standard procedure during forest fires for the authorities to shut off electrical power to communities in the path of the fire. Each house vent is mechanically opened and closed by an electric solenoid actuator that is connected by electrical wiring to a special circuit breaker located in the house electrical panel or breaker box.

12 Claims, 11 Drawing Sheets

AUTOMATIC HOUSE VENT

BACKGROUND OF THE INVENTION

1. Field of the Invention

This invention relates to automatic house vents and to circuit breakers. One or more automatic or automated house vents that can automatically open and close is connected to a special circuit breaker that controls the automatic house vents and automatically closes all automatic house vents in the event of a power outage or a power disconnection to the house, home, or building.

2. Description of Related Art

Applicants are victims of the Camp Fire in Paradise, Calif., which was the largest and most destructive forest fire in U.S. history at the time of this writing. Applicants' homes were set fire by burning ambers that blew into their house vents and started fires from the inside of the house. Many new homes in forest fire areas are now being built with fireproof roofs and fireproof siding but still have fire vulnerability through their venting systems. Applicants have invented this automatic house vent system that automatically closes all house vents in the house, home, or building when electrical power is shut off to the home or community. It is standard practice for the authorities to shut off electrical power to all communities in the path of a forest fire. Automatic house vent system will then keep all house vents closed until if and when power is restored to the house, home, or building and a person manually resets the automatic house vent system. If power is restored without a person manually resetting the system, all house vents remain closed.

There are many automated house vents in the prior art. There are many circuit breakers in the prior art. However, no devices have an automated house vent connected to a special circuit breaker as shown and described here that automatically closes all house vents when there is a power outage or when electrical feed power is cut-off to the house, home, or building.

BRIEF SUMMARY OF THE INVENTION

It is an aspect of automatic house vent to include at least one actuated house vent that opens and closes as a result of electrical signaling or lack thereof.

It is an aspect of at least one actuated house vent to include a solenoid actuator that is capable of opening and closing the house vent.

It is an aspect of automatic house vent to include a special automatic house vent circuit breaker with electric continuity with at least one actuated house vent or a plurality of actuated house vents.

It is an aspect of automatic house vent to automatically close all actuated house vents when electrical power is shut off or disconnected to the house, home, or building.

It is an aspect of automatic house vent to automatically keep all actuated house vents closed when electrical power is restored or reconnected to the house, home, or building where the special automatic house vent circuit breaker has not been manually reset.

It is an aspect of automatic house vent to automatically open all actuated house vents when electrical power is restored or reconnected to the house, home, or building and the special automatic house vent circuit breaker is manually reset.

It is an aspect of automatic house vent to include a plurality of actuated house vents, each connected to a special automatic house vent circuit breaker by electrical wiring.

It is an aspect of special automatic house vent circuit breaker to be compatible with and capable of being installed within a standard electrical panel or breaker box.

It is an aspect of special automatic house vent circuit breaker to include a solenoid actuator that actuates to trip the circuit breaker when power is disconnected or shut off to the circuit breaker.

DEFINITION LIST

Figure 1:
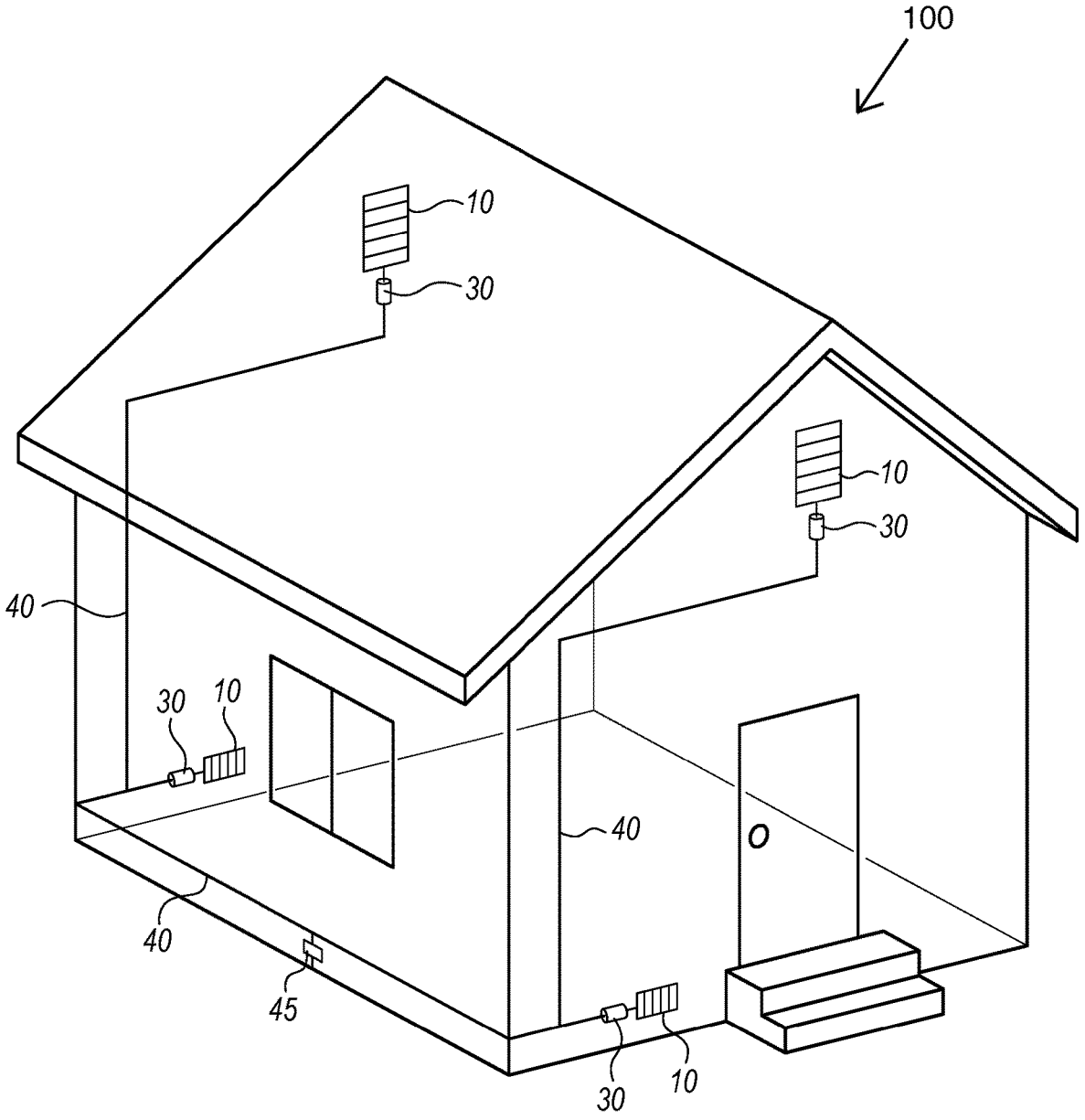
FIG. 1 is a perspective view of a house, home, or building with electrical panel or breaker box, electrical wiring, and a plurality of house vents, each with a vent solenoid.

| Term | Definition |
|---|---|
| 10 | House Vent |
| 12 | Shutter Vent |
| 13 | Shutter Vent Frame |
| 14 | Pivoting Shutter Blade |
| 15 | Pivoting Shutter Blade Pivot Axis |
| 16 | Shutter Rod |
| 17 | Rectangular or Square Louvered Vent |
| 18 | Rectangular or Square Louvered Vent Frame |
| 19 | First Aperture Sheet |
| 20 | Second Aperture Sheet |
| 21 | Second Aperture Sheet Rod |
| 22 | Round Louvered Vent |
| 23 | First Round Aperture Sheet |
| 24 | Second Round Aperture Sheet |
| 25 | Second Round Aperture Sheet Pivot Point |
| 26 | Second Round Aperture Sheet Rod |
| 27 | Round Louvered Vent Frame |
| 30 | Vent Solenoid |
| 32 | Vent Solenoid Inductive Coil |
| 34 | Vent Solenoid Armature |
| 36 | Vent Solenoid Spring |
| 40 | Electrical Wiring |
| 45 | Electric Panel or Breaker Box |
| 50 | Automatic House Vent Circuit Breaker |
| 51 | Load Wire Input Terminal |
| 52 | Neutral Wire Input Terminal |
| 53 | Circuit Breaker Switch |
| 54 | Circuit Breaker Switch Pivot Pin |
| 55 | Pivoting Electrical Contact |
| 56 | Pivoting Electrical Contact Pivot Point |
| 57 | Pivoting Electrical Contact Spring |
| 58 | Pivoting Electrical Contact Wire |
| 59 | Pivoting Catch Arm |
| 60 | Pivoting Catch Arm Pivot Pin |
| 61 | Pivoting Catch Arm Stop Pin |
| 62 | Bimetal Strip |
| 64 | Bimetal Strip Extension Bracket |
| 65 | Bimetal Strip Pivot Point |
| 66 | Bimetal Strip Spring |
| 67 | Bimetal Strip Electrical Bridge |
| 68 | Circuit Board |
| 69 | Integrated Circuit or Chip |
| 70 | Load Wire Input to Circuit Board |
| 71 | Neutral Wire Input to Circuit Board |
| 72 | Circuit Breaker Solenoid |
| 73 | Circuit Breaker Solenoid Inductive Coil |
| 74 | Circuit Breaker Solenoid Armature |
| 75 | Circuit Breaker Solenoid Extension Bracket |
| 76 | Load Wire Output from Circuit Board |
| 77 | Neutral Wire Output from Circuit Board |
| 78 | Ground Fault Sensor |
| 79 | Arc Fault Sensor |
| 80 | Load Bridge Wire |
| 81 | Neutral Bridge Wire |
| 82 | Load Wire Exit Terminal |
| 83 | Neutral Wire Exit Terminal |
| 90 | Front Surface of Automatic House Vent Circuit Breaker |
| 91 | Rear Surface of Automatic House Vent Circuit Breaker |
| 92 | Upper Surface of Automatic House Vent Circuit Breaker |
| 93 | Lower Surface of Automatic House Vent Circuit Breaker |
| 94 | Right Surface of Automatic House Vent Circuit Breaker |
| 95 | Left Surface of Automatic House Vent Circuit Breaker |
| 100 | House, Home, or Building |

DETAILED DESCRIPTION OF THE INVENTION

Automatic house vent 5 comprises: at least one house vent 10, at least one vent solenoid 30, a plurality of electrical wiring 40, and an automatic house vent circuit breaker 50. Each house vent 10 is mechanically linked or connected to a vent solenoid 30 so that the vent solenoid 30 may actuate to open and close the house vent 10. Thus, there is an equivalent amount of house vents 10 and vent solenoids 30 installed into a house, home, or building 100. Typically, a house, home, or building 100 has a plurality of house vents 10. Each vent solenoid 30 is connected to an automatic house vent circuit breaker 50 by electrical wiring 40.

Figure 4:
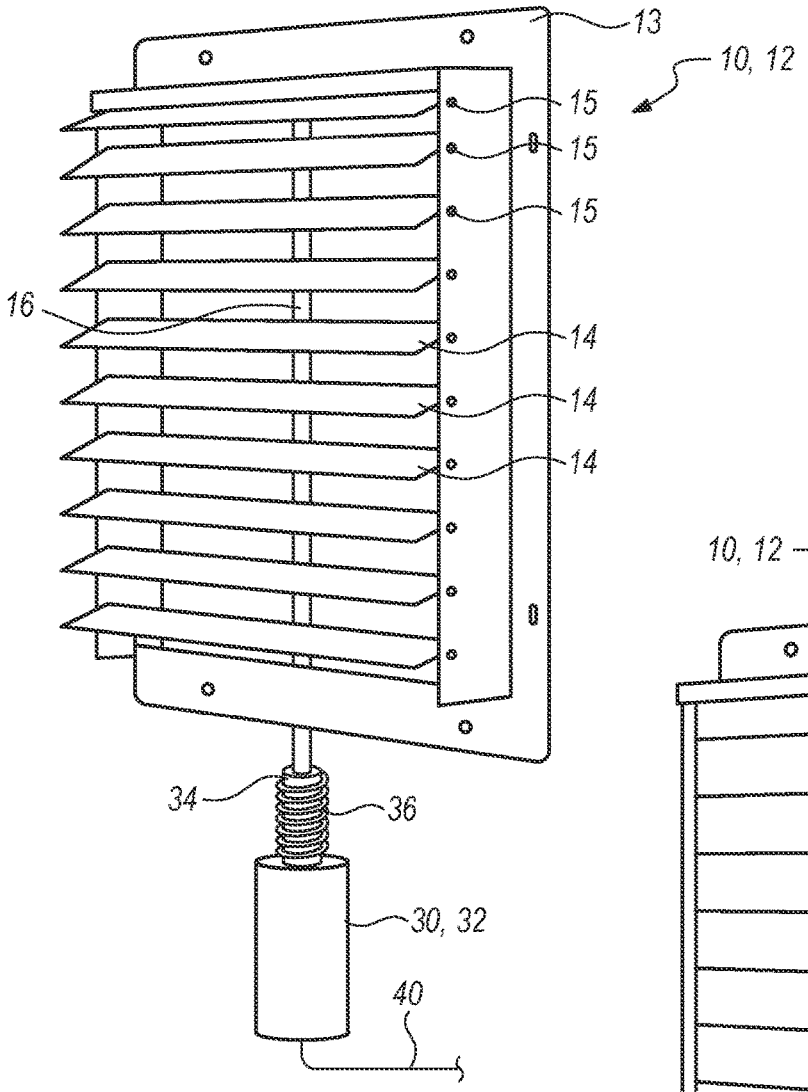
FIG. 4 is a perspective view of another shutter vent with a vent solenoid that is in the open position.
Figure 5:
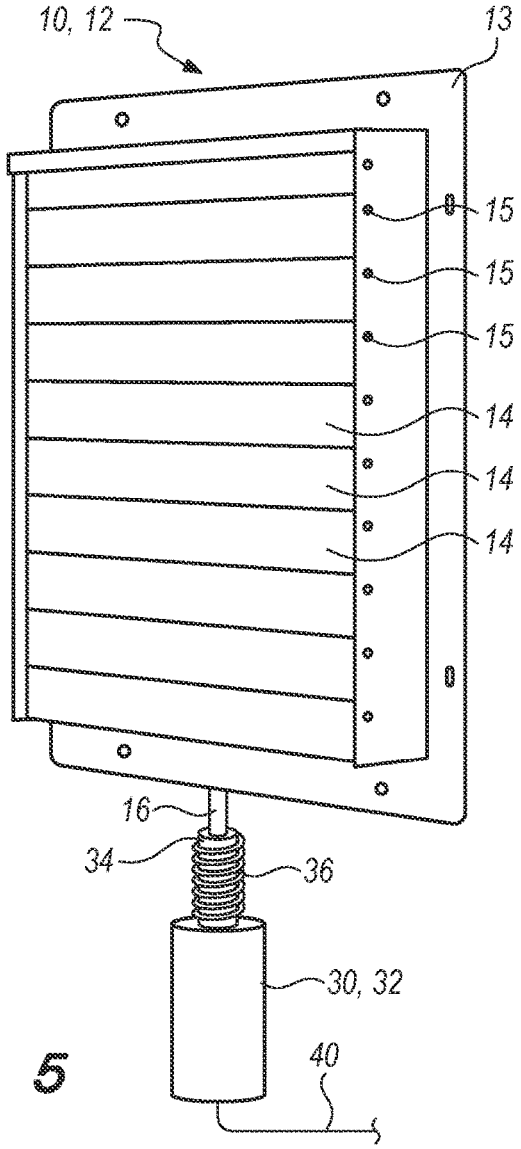
FIG. 5 is a perspective view of another shutter vent with a vent solenoid that is in the closed position.
Figure 6:
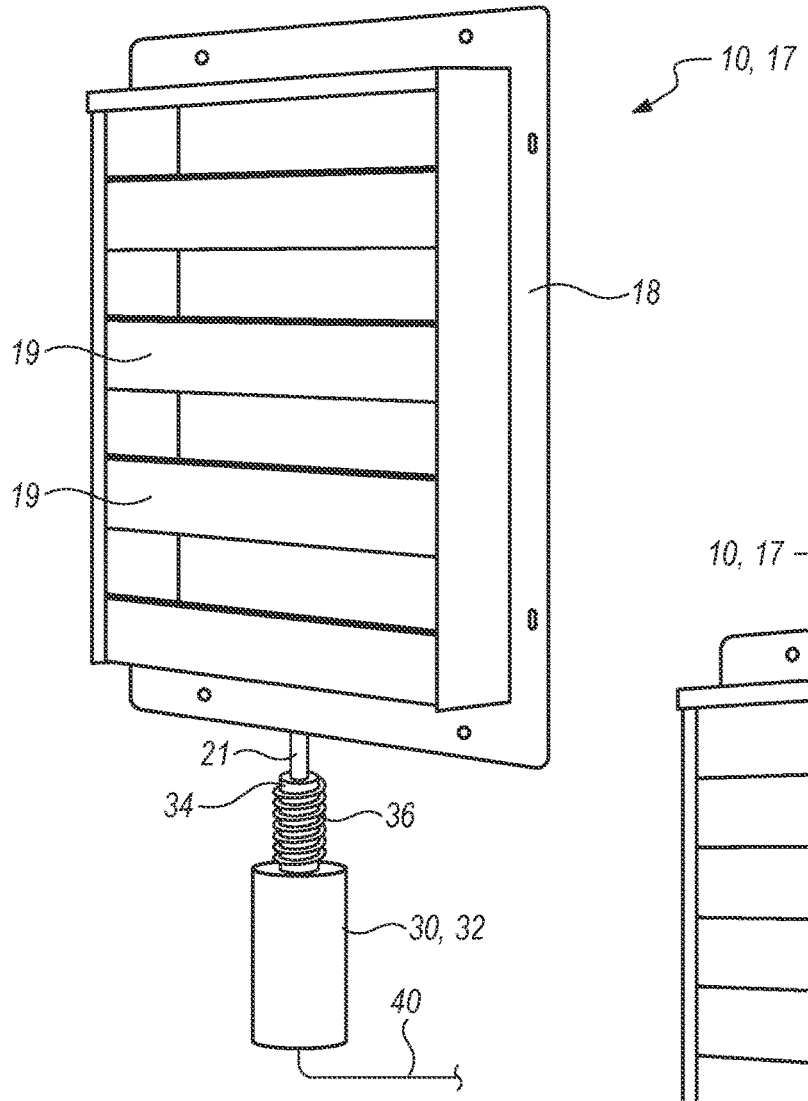
FIG. 6 is a perspective view of a rectangular or square louvered vent with a vent solenoid that is in the open position.
Figure 7:
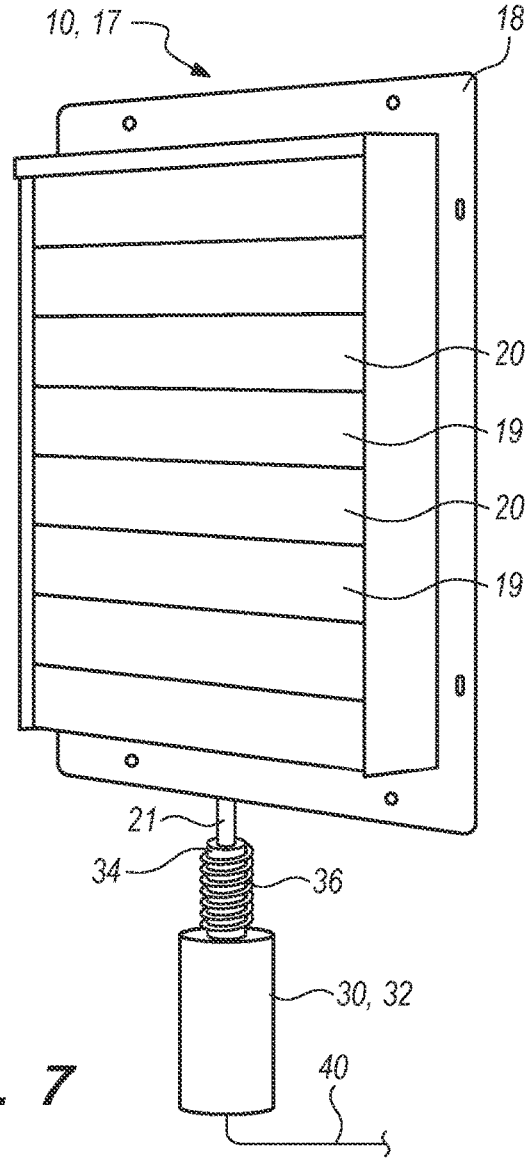
FIG. 7 is a perspective view of a rectangular or square louvered vent with a vent solenoid that is in the closed position.
Figure 8:
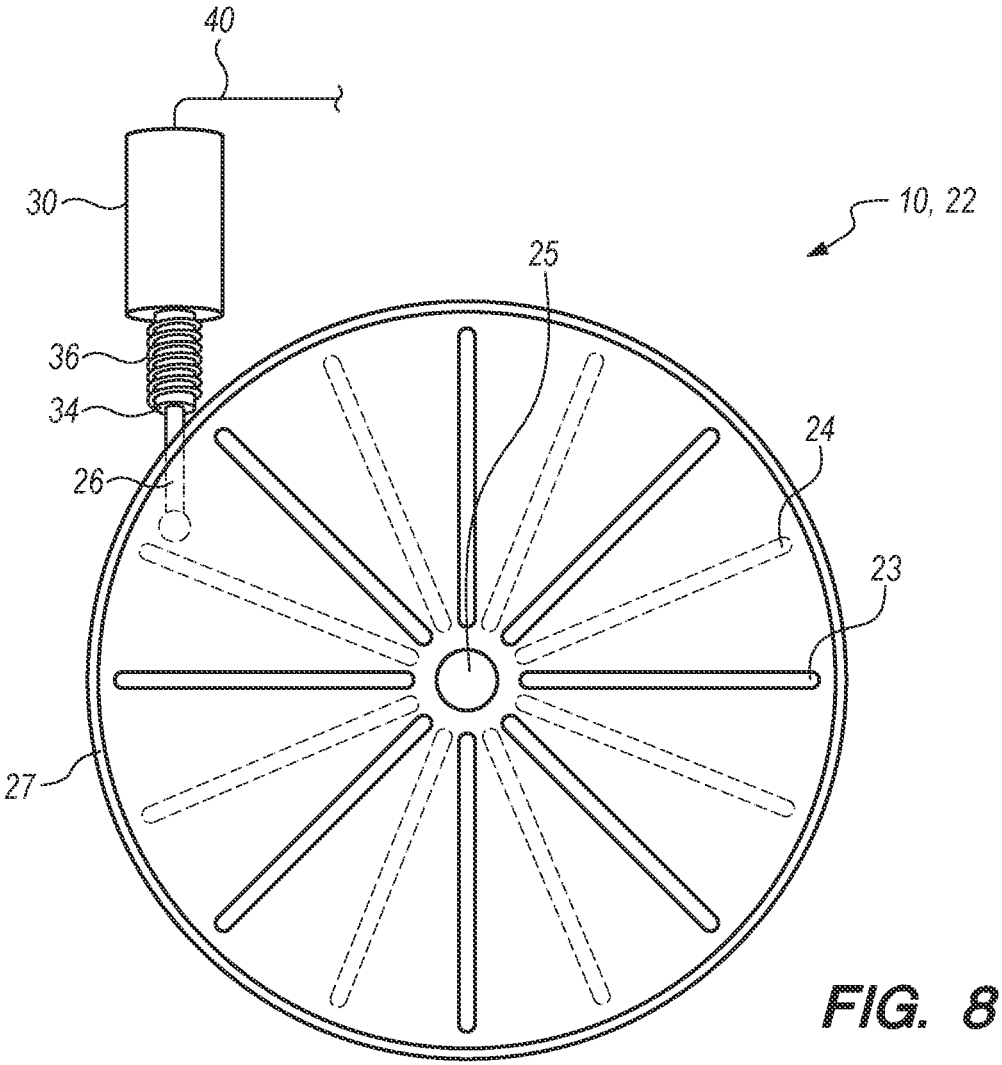
FIG. 8 is a perspective view of a round louvered vent with a vent solenoid that is in the open position.
Figure 9:
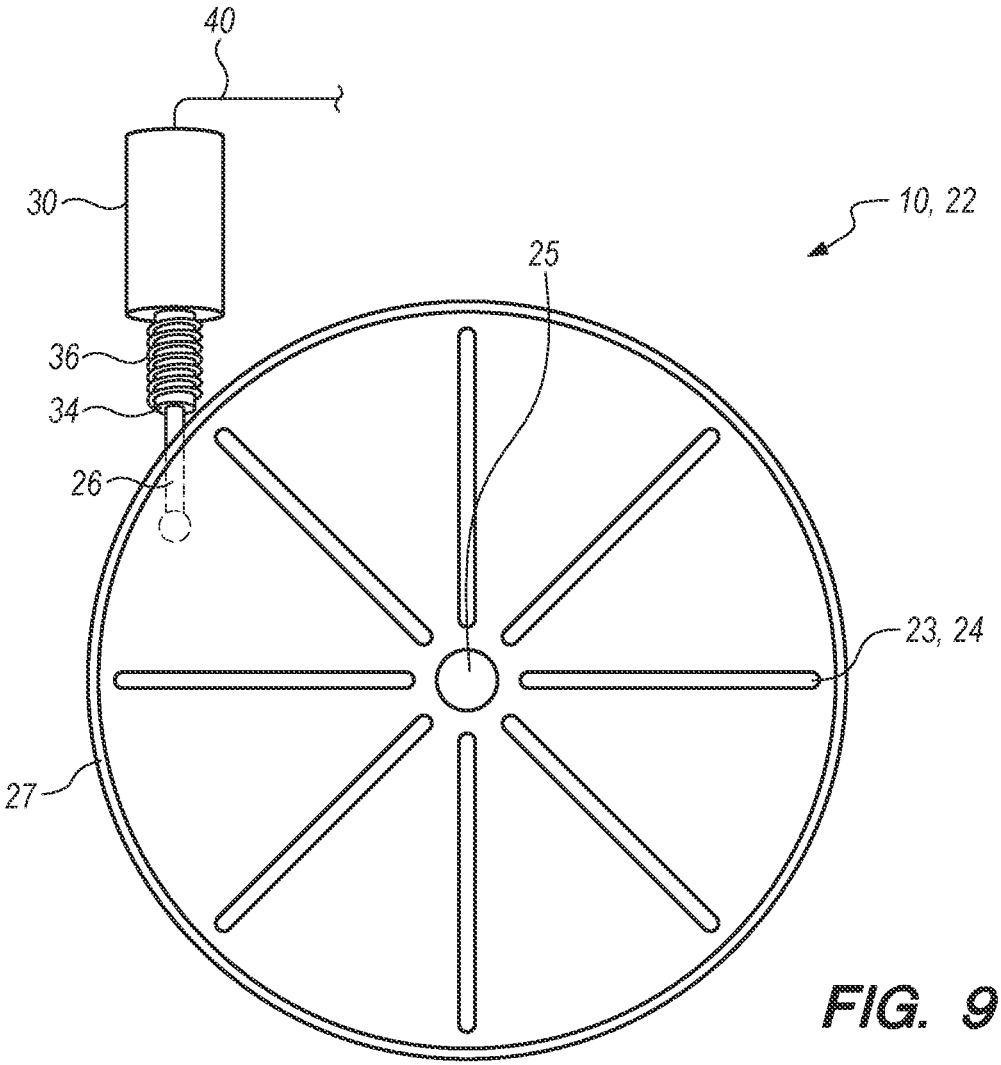
FIG. 9 is a perspective view of a round louvered vent with a vent solenoid that is in the closed position.
Figure 10:
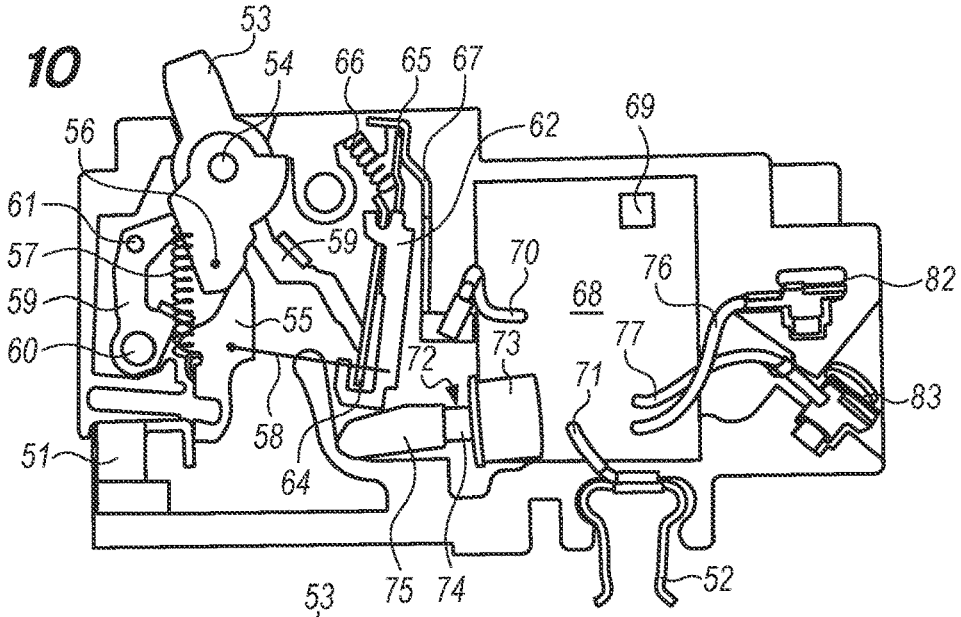
FIG. 10 a cutaway view of the inside of a first mode of automatic house vent circuit breaker with circuit breaker switch in the circuit closed position.
Figure 11:
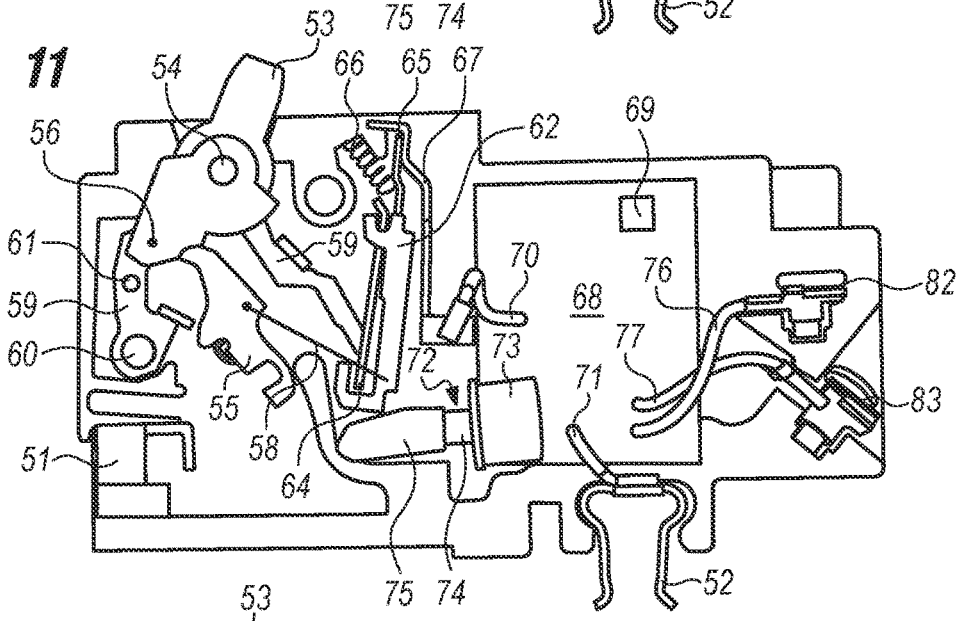
FIG. 11 a cutaway view of the inside of a first mode of automatic house vent circuit breaker with circuit breaker switch in the circuit open position.
Figure 12:
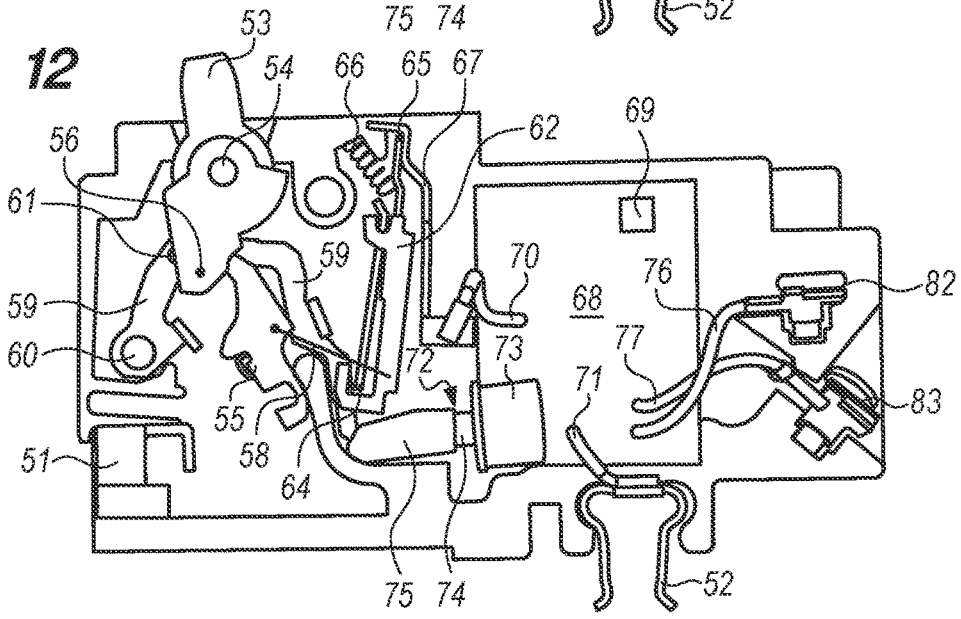
FIG. 12 a cutaway view of the inside of a first mode of automatic house vent circuit breaker with circuit breaker switch in the circuit tripped position.

At least one house vent 10 may be: a shutter vent 12, a rectangular or square louvered vent 17, or a round louvered vent 22. Shutter vent 12 is depicted in FIGS. 2-5. Rectangular or square louvered vent 17 is depicted in FIGS. 6-7. Round louvered vent 22 is depicted in FIGS. 8-9.

Figure 2:
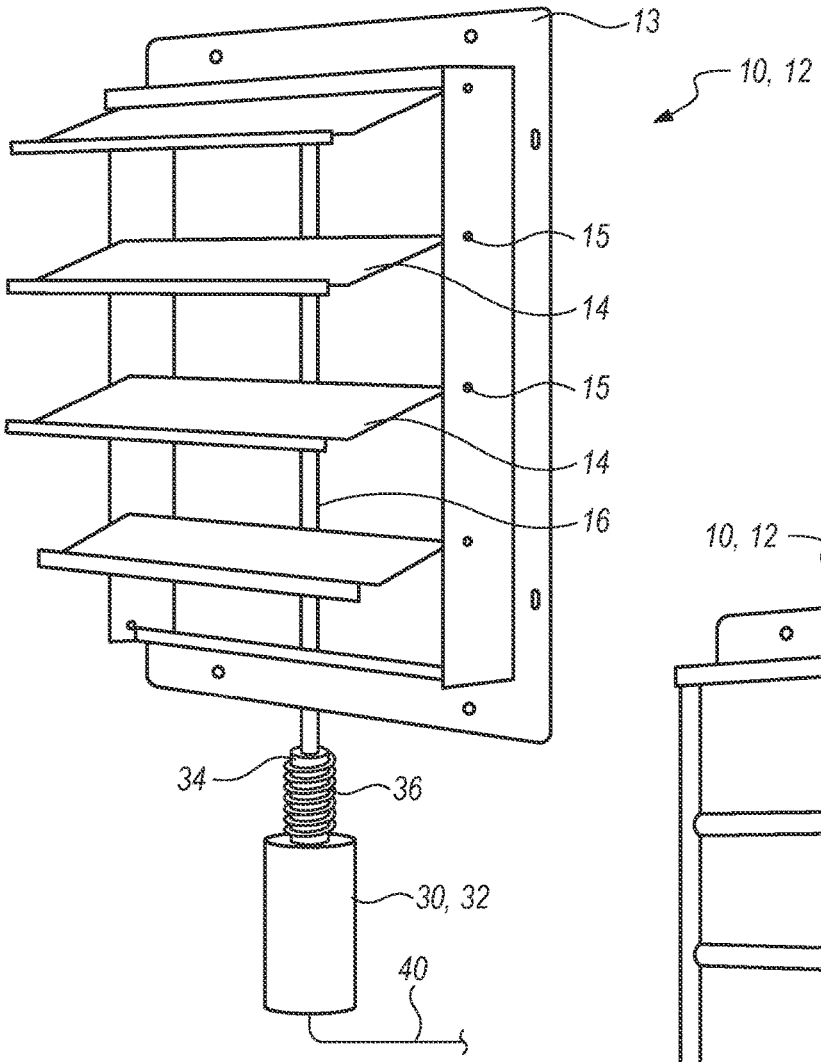
FIG. 2 is a perspective view of a shutter vent with a vent solenoid that is in the open position.
Figure 3:
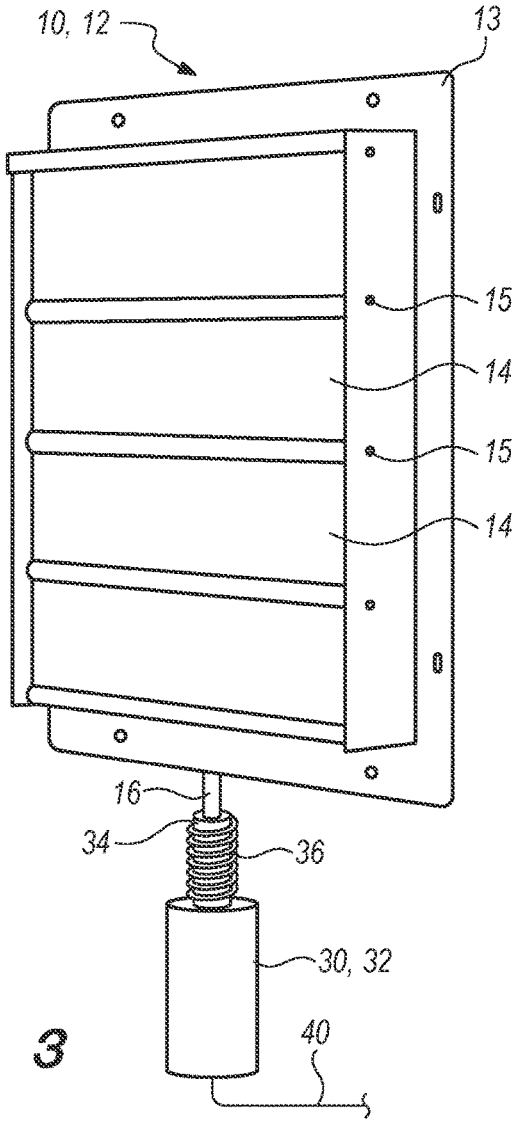
FIG. 3 is a perspective view of a shutter vent with a vent solenoid that is in the closed position.

Shutter vent 12 comprises: a shutter vent frame 13, a plurality of pivoting shutter blades 14, and a shutter rod 16. Shutter vent frame 13 is a rigid structural member or frame member with a left support, a right support, a top support, a bottom support, and a rectangular or square opening in the center. Each pivoting shutter blade 14 is a rigid rectangular planar member with an inside surface, an outside surface, a left edge, a right edge, a top edge, a bottom edge, and a longitudinal axis. There is a left hinge pin located on the left edge of each pivoting shutter blade 14 in between the top edge and the bottom edge of pivoting shutter blade 14. Left hinge pin is a rigid cylindrical member with a first end, a second end, and a longitudinal axis. The first end is attached to the left edge of pivoting shutter blade 14. The second end of left hinge pin protrudes perpendicularly from the left edge of pivoting shutter blade 14. There is a right hinge pin located on the right edge of each pivoting shutter blade 14 in between the top edge and the bottom edge of pivoting shutter blade 14. Right hinge pin is a rigid cylindrical member with a first end, a second end, and a longitudinal axis. The first end is attached to the right edge of pivoting shutter blade 14. The second end of right hinge pin protrudes perpendicularly from the right edge of pivoting shutter blade 14. The axes of left and right hinge pins are coincident with each other and perpendicular to the right and left edges of pivoting shutter blade 14. Each pivoting shutter blade 14 is pivotally attached to shutter vent frame 13 so that each its longitudinal axis is horizontal and perpendicular to the left and right supports of shutter vent frame 13 and parallel with the top and bottom supports of shutter vent frame 13. Left hinge pin is positioned and placed within a hole on the left support of shutter vent frame 13 to form a pivoting attachment therein. Right hinge pin is positioned and placed within a hole on the right support of shutter vent frame 13 to form a pivoting attachment therein. A plurality of pivoting shutter blades 14 is used to cover the entire rectangular or square opening in the center shutter vent frame 13. Shutter rod 16 is a rigid vertical cylindrical member with an upper end, a middle section, a lower end, and a longitudinal axis. Shutter rod 16 functions to link all of the pivoting shutter blades 14 to vent solenoid armature 34. The lower end of shutter rod 16 is rigidly attached to the second end of vent solenoid armature 34. The upper end of shutter rod 16 is attached to the top edge of the upper most pivoting shutter blade 14. The top edge of all other pivoting shutter blades 14 is attached to the middle section of shutter rod 16. Alternately, the upper end of shutter rod 16 may be attached to only one pivoting shutter blade 14 where all pivoting shutter blades 14 are linked together with a linkage rod or linkage. Shutter rod 16 actuates by moving upwards and downwards while the longitudinal axis of shutter rod 16 remains vertical. As shutter rod 16 moves upwards and downwards, it rotates all the top edges of all pivoting shutter blades 14 upwards and downwards, thereby pivoting all pivoting shutter blades 14 to open position and the closed position. In this way, as the shutter rod 16 moves upwards, all pivoting shutter blades 14 pivot closed, as depicted in FIGS. 3 and 5. As the shutter rod 16 moves downwards, all pivoting shutter blades 14 pivot open, as depicted in FIGS. 2 and 4.

Vent solenoid 30 is an electromechanical solenoid that moves an armature into an extended position and/or retracts the armature into a retracted position by electrifying an inductive coil. Electrical current passing through an inductive coil creates an inductive force that acts upon the conductive armature located in the center of the inductive coil. The armature is slideably attached inside of the inductive coil where the armature may be extended or retracted by controlling the direction and amount of electrical current passing through the inductive oil. The inductive coil is connected to a power source, battery, or electromotive force in order to create the electrical current. The magnetic field or magnetic force points in one direction when the first end of solenoid inductive coil is connected to the positive connection on a power source, battery, or electromotive force and the second end solenoid inductive coil is connected to the negative connection on a power source, battery, or electromotive force. The magnetic field or magnetic force points in the opposite direction when the first end of solenoid inductive coil is connected to the negative connection on a power source, battery, or electromotive force and the second end solenoid inductive coil is connected to the positive connection on a power source, battery, or electromotive force.

Vent solenoid 30 may be any known type of electromechanical solenoid. Vent solenoid 30 comprises: a vent solenoid inductive coil 32 and a vent solenoid armature 34. Vent solenoid inductive coil 32 is a cylindrical coil of metallic conductive wire with a first end, a second end, and a longitudinal axis. Vent solenoid inductive coil 32 consists of a large number of coils of metallic conductive wire. Vent solenoid 30 is cylindrical shaped with a hollow center. Vent solenoid 30 functions to induce a magnetic field or a magnetic force in the hollow center of the cylindrical shape. The magnetic field is created by passing electrical current through vent solenoid inductive coil 32. The magnetic field produced runs parallel to the longitudinal axis of vent solenoid inductive coil 32. Vent solenoid armature 34 is a rigid cylindrical member with a first end, a second end, and a longitudinal axis. Vent solenoid armature 34 is made of conductive material such as metal. Vent solenoid armature 34 is slideably attached inside of vent solenoid inductive coil 32 with its longitudinal axis coincident with that of vent solenoid inductive coil 32. The first end of vent solenoid armature 34 is located in the center of vent solenoid inductive coil 32. The second end of vent solenoid armature 34 protrudes out of one end of vent solenoid inductive coil 32.

The first end of vent solenoid inductive coil 32 is connected to load wire exit terminal 82 or to neutral wire exit terminal 83 by electrical wiring 40 so that there is electrical continuity between these members. The second end of vent solenoid inductive coil 32 is connected to load wire exit terminal 82 or to neutral wire exit terminal 83 by electrical wiring 40 so that there is electrical continuity between these members. In this way there is electrical continuity between vent solenoid inductive coil 32 and circuit board 68. Circuit board 68 functions as the power source, battery, or electromotive force to create the electrical current in vent solenoid inductive coil 32 and the resulting magnetic field or magnetic force. In best mode, vent solenoid 30 is a "normally open" electromechanical solenoid, which means the vent solenoid armature 34 is in the extended position when power is not applied to the vent solenoid inductive coil 32 and the vent solenoid armature 34 is in the retracted position when power is supplied to the vent solenoid inductive coil 32. In another mode, at least one integrated circuit or chip 69 is programmed with instructions or read only memory that is used to control the extension and retraction of vent solenoid armature 34. In this mode, circuit board 68 and at least one integrated circuit or chip 69 function in tandem to control the electrical current in vent solenoid inductive coil 32. In this mode, circuit board 68 and integrated circuit or chip 69 can initiate electric current across vent solenoid inductive coil 32 in either direction to create the magnetic field or magnetic force in either direction in order to extend or retract vent solenoid armature 34.

Vent solenoid 30 may further comprise a vent solenoid spring 36. Vent solenoid spring 36 is a helical spring or coil spring with a first end, a second end, and a longitudinal axis. Vent solenoid spring 36 may be any known type of spring. Vent solenoid spring 36 functions to continuously force or push shutter rod 16 upwards. Vent solenoid spring 36 is located or installed over the second end vent solenoid armature 34. The first end of vent solenoid spring 36 is slid over the second end of vent solenoid armature 34 to contact vent solenoid inductive coil 32 or a housing covering vent solenoid inductive coil 32. Vent solenoid spring 36 is then compressed and a spring stop is installed on vent solenoid armature 34 to keep vent solenoid spring 36 in a compressed state. Spring stop is a baffle, wall, washer, nut, or fastener that is rigidly attached to vent solenoid armature 34 to hold vent solenoid spring 36 in the compressed condition. The outer diameter of spring stop must be larger than that of vent solenoid spring 36 in order to retain vent solenoid spring 36 and prevent it from sliding over the spring stop. Spring stop is attached to vent solenoid armature 34 near the second end of vent solenoid armature 34. In this mode, vent solenoid armature 34 may still retract and extend even though vent solenoid spring 36 continuously pushes vent solenoid armature 34 upwards. Thus, when in the retracted, the inductive force from vent solenoid inductive coil 32 must be greater than the extension force provided by vent solenoid spring 36. Vent solenoid spring 36 is a fail safe or safety mechanism that forces the shutter rod 16 upwards in the event of a power loss to the vent solenoid 30. In this mode, vent solenoid spring 36 forces or pushes the shutter rod 16 upwards to insure that all pivoting shutter blades 14 are closed in the event of a power loss. Also, in this mode, all pivoting shutter blades 14 are forced closed in the event of a vent solenoid 30 failure or malfunction and/or integrated circuit or chip 69 failure or malfunction.

Rectangular or square louvered vent 17 comprises: a rectangular or square louvered vent frame 18, a first aperture sheet 19, a second aperture sheet 20, and a second aperture sheet rod 21. Rectangular or square louvered vent frame 18 is a rigid structural member or frame member with a left support, a right support, a top support, a bottom support, and a rectangular or square opening in the center. First aperture sheet 19 is a rigid planar square or rectangular member with an inside surface, an outside surface, a left edge, a right edge, a top edge, a bottom edge, and a plurality of rectangular apertures, vents, or holes. Second aperture sheet 20 is a rigid planar square or rectangular member with an inside surface, an outside surface, a left edge, a right edge, a top edge, a bottom edge, and a plurality of rectangular apertures, vents, or holes. The rectangular apertures, vents, or holes in first aperture sheet 19 are the same size as those in second aperture sheet 20. Rectangular apertures, vents, or holes in first aperture sheet 19 and second aperture sheet 20 are each evenly spaced with a center to center distance that is equal to or greater than the width of the rectangular apertures, vents, or holes. First and second aperture sheets 19,20 each have the same number of rectangular apertures, vents, or holes. The rectangular apertures, vents, or holes in first aperture sheet 19 are in the same locations as those in second aperture sheet 20. First aperture sheet 19 is rigidly attached to rectangular or square louvered vent frame 18 to cover the rectangular or square opening in the center of rectangular or square louvered vent frame 18. Second aperture sheet 20 is slideably attached to rectangular or square louvered vent frame 18 to cover the rectangular or square opening in the center of rectangular or square louvered vent frame 18. Second aperture sheet 20 may slide along a track in rectangular or square louvered vent frame 18 while first aperture sheet 19 remains stationary with rectangular or square louvered vent frame 18. Second aperture sheet 20 may slide into a position where each of its rectangular apertures, vents, or holes aligns with those of first aperture sheet 19 as depicted in FIG. 6. This is the open position where rectangular or square louvered vent 17 is open to allow air ventilation. Second aperture sheet 20 may also slide into a position where each of its rectangular apertures, vents, or holes aligns with closed space between the rectangular apertures, vents, or holes on first aperture sheet 19 as depicted in FIG. 7. This is the closed position where rectangular or square louvered vent 17 is closed to prevent air ventilation. Second aperture sheet rod 21 is a rigid cylindrical member with a first end, a middle section, a second end, and a longitudinal axis. Second aperture sheet rod 21 functions to link the second aperture sheet 20 to vent solenoid armature 34. The first end of second aperture sheet rod 21 is rigidly attached to the second end of vent solenoid armature 34. The second end of second aperture sheet rod 21 is attached to the left edge, right edge, top edge, or bottom edge of second aperture sheet 20. Second aperture sheet rod 21 moves with vent solenoid armature 34 to actuate back and forth along with vent solenoid armature 34. In this way, vent solenoid 30 functions or actuates to move or slide second aperture sheet 20 back and forth into a vent closed position and into a vent open position. In modes with a vent solenoid spring 36, vent solenoid spring 36 forces or pushes the second aperture sheet rod 21 into the closed position to insure that rectangular or square louvered vent 17 is closed to prevent air ventilation in the event of a power loss, vent solenoid 30 failure or malfunction, or integrated circuit or chip 69 failure or malfunction.

Round louvered vent 22 comprises: a first round aperture sheet 23, a second round aperture sheet 24, a second round aperture sheet pivot point 25, a second round aperture sheet rod 26, and a round louvered vent frame 27. Round louvered vent frame 27 is a rigid circular structural member or frame member with a center and a circular opening in the center. First round aperture sheet 23 is a rigid planar circular member with an inside surface, an outside surface, a center, a circumference edge, and a plurality of apertures, vents, or holes. Second round aperture sheet 24 is a rigid planar circular member with an inside surface, an outside surface, a center, a circumference edge, and a plurality of apertures, vents, or holes. The apertures, vents, or holes in first round aperture sheet 23 are the same size as those in second round aperture sheet 24. Apertures, vents, or holes in first round aperture sheet 23 and second round aperture sheet 24 are each positioned radially about their respective centers with a center to center distance that is equal to or greater than the width of the apertures, vents, or holes. First and second round aperture sheets 23,24 each have the same number of apertures, vents, or holes. The apertures, vents, or holes in first round aperture sheet 23 are in the same locations as those in second round aperture sheet 24. First round aperture sheet 23 is rigidly attached to round louvered vent frame 27 to cover the circular opening in the center of round louvered vent frame 27. Second round aperture sheet 24 is pivotally attached to round louvered vent frame 27 to cover the circular opening in the center of round louvered vent frame 27. The centers of first and second round aperture sheets 23,24 are coincident with the center of round louvered vent frame 27. This center point is the second round aperture sheet pivot point 25. Second round aperture sheet 24 pivotally attached so that it may pivot around second round aperture sheet pivot point 25 while first round aperture sheet 23 remains stationary with round louvered vent frame 27. Second round aperture sheet 24 may slide into a position where each of its apertures, vents, or holes aligns with those of first round aperture sheet 23 as depicted in FIG. 9. This is the open position where round louvered vent 22 is open to allow air ventilation. Second round aperture sheet 24 may also slide into a position where each of its apertures, vents, or holes aligns with space between the apertures, vents, or holes on first round aperture sheet 23 as depicted in FIG. 8. This is the closed position where round louvered vent 22 is closed to prevent air ventilation. Second round aperture sheet rod 26 is a rigid cylindrical member with a first end, a middle section, a second end, and a longitudinal axis. Second round aperture sheet rod 26 functions to link the second round aperture sheet 24 to vent solenoid armature 34. The first end of second round aperture sheet rod 26 is rigidly attached to the second end of vent solenoid armature 34. The second end of second round aperture sheet rod 26 is attached to the circumference edge of second round aperture sheet 24. Second round aperture sheet rod 26 moves with vent solenoid armature 34 to actuate back and forth along with vent solenoid armature 34. In this way, vent solenoid 30 functions or actuates to rotate second round aperture sheet 24 back and forth in into a vent closed position and into a vent open position. In modes with a vent solenoid spring 36, vent solenoid spring 36 forces or pushes the second round aperture sheet rod 26 into the closed position to insure that round louvered vent 22 is closed to prevent air ventilation in the event of a power loss, vent solenoid 30 failure or malfunction, or integrated circuit or chip 69 failure or malfunction.

Automatic house vent circuit breaker 50 is a circuit breaker that is reversibly attachable to an electric panel or breaker box 45. Electric panel or breaker box 45 is an electric panel or breaker box that is a standard component of any electrical system on a house, home, or building 100. Electric panel or breaker box 45 is not part of this invention. Any electric panel or breaker box 45 has one or more slots that each accept a circuit breaker. A circuit breaker is an automatic electrical switch that automatically shuts off power to an electrical circuit within a house, home, or building 100 in order to prevent damage or a fire within the house, home, or building 100. A circuit breaker detects short circuit loads and excess current loads within the circuit and then automatically shuts off electrical power to the circuit. A plurality of circuit breakers is standard equipment of any house, home, or building 100 electrical system. Each circuit breaker monitors a particular circuit of electric current within the house, home, or building 100. When a circuit breaker detects excess current or a short circuit in the electric circuit, the circuit breaker trips or opens to prevent any electric current from travelling through the electric circuit in the house, home, or building 100. When the circuit breaker is tripped or in the open position, electric current cannot flow through the circuit, which in turn prevents a fire from starting within the electrical wires in the house, home or building 100. When the circuit breaker is tripped or in the open position, electrical wires cannot overheat or arc, thereby preventing fires from starting within the electrical wires in the house, home, or building 100. After a circuit breaker has tripped, it must be manually reset or closed in order to allow current to pass through the circuit again. This means a person must physically go to the electric panel or breaker box 45 to manually reset or close the circuit breaker switch to allow electric current to pass through the circuit again.

Automatic house vent circuit breaker 50 is a special circuit breaker that is a component of this invention. Automatic house vent circuit breaker 50 is reversibly attachable to a slot within a house electric panel or breaker box 45. Automatic house vent circuit breaker 50 comprises: a load wire input terminal 51, a neutral wire input terminal 52, a circuit breaker switch 53, a circuit breaker switch pivot pin 54, a pivoting electrical contact 55, a pivoting electrical contact pivot point 56, a pivoting electrical contact spring 57, a pivoting electrical contact wire 58, a pivoting catch arm 59, a pivoting catch arm pivot pin 60, a pivoting catch arm stop pin 61, a bimetal strip 62, a bimetal strip extension bracket 64, a bimetal strip pivot point 65, bimetal strip spring 66, a bimetal strip electrical bridge 67, a circuit board 68, a load wire input to circuit board 70, a neutral wire input to circuit board 71, a circuit breaker solenoid 72, a circuit breaker solenoid extension bracket 75, a load wire output from circuit board 76, a neutral wire output from circuit board 77, a load wire exit terminal 82, and a neutral wire exit terminal 83. Automatic house vent circuit breaker 50 may further comprise at least one integrated circuit or chip 69. These modes are depicted in FIGS. 10-21. At least one integrated circuit or chip 69 is not required but is optional to add additional control capabilities.

Automatic house vent circuit breaker 50 is has a rigid housing or casing that is essentially a rectangular cuboid shaped member or similarly shaped member with a front surface 90, a rear surface 91, an upper surface 92, a lower surface 93, a right surface 94, and a left surface 95. These surfaces make up a rigid housing or a rigid casing with an essentially hollow interior.

Load wire input terminal 51 is an electrical terminal or electrical connector that is made from conductive material such as metal. Load wire input terminal 51 is located on the right rear corner of housing of automatic house vent circuit breaker 50 or at the intersection of the rear surface 91 and the right surface 94 of automatic house vent circuit breaker 50. Neutral wire input terminal 52 is an electrical terminal or electrical connector. Neutral wire input terminal 52 is located on rear surface 91 of automatic house vent circuit breaker 50.

Circuit breaker switch 53 is located on the front surface 90 of automatic house vent circuit breaker 50. Circuit breaker switch 53 is a rigid oblong member with a first end, a middle section, and a second end. The middle section of circuit breaker switch 53 is pivotally attached to circuit breaker switch pivot pin 54. Circuit breaker switch pivot pin 54 is a rigid vertical cylindrical member with a first end that is attached to the upper surface 92 and a second end that is attached to the lower surface 93 of housing of automatic house vent circuit breaker 50. Circuit breaker switch 53 pivots about circuit breaker switch pivot pin 54. The first end of circuit breaker switch 53 protrudes through the front surface 90 of housing of automatic house vent circuit breaker 50. The first end of circuit breaker switch 53 has a circuit closed position, a circuit open position, and a circuit tripped position.

Pivoting electrical contact 55 is a rigid oblong member with a first end, a middle section, and a second end. Pivoting electrical contact 55 is made from conductive material such as metal. The first end of pivoting electrical contact 55 is pivotally attached to the second end of circuit breaker switch 53 at pivoting electrical contact pivot point 56. Thus, pivoting electrical contact 55 pivots about pivoting electrical contact pivot point 56, which in turn pivots about circuit breaker switch pivot pin 54. When circuit breaker switch 53 is in the circuit closed position, the first end of circuit breaker switch 53 is oriented or leaning towards the right surface 94 of automatic house vent circuit breaker 50 and is the position closest to the right surface 94 of automatic house vent circuit breaker 50. In this position, pivoting electrical contact spring 57 pulls the second end of pivoting electrical contact 55 towards the right surface of automatic house vent circuit breaker 50. When circuit breaker switch 53 is in the circuit open position, the first end of circuit breaker switch 53 is oriented or leaning towards the left surface 95 of automatic house vent circuit breaker 50 and is the position closest to the left surface 95 of automatic house vent circuit breaker 50. In this position, pivoting electrical contact spring 57 pulls the second end of pivoting electrical contact 55 towards the left surface 95 of automatic house vent circuit breaker 50.

Pivoting catch arm 59 is a rigid U-shaped member wherein the open end of the U-shape faces the rear surface 91 of automatic house vent circuit breaker 50. Pivoting catch arm 59 has a first end, a middle section, and a second end. Pivoting catch arm pivot pin 60 is a rigid vertical cylindrical member with a first end that is attached to the upper surface 92 and a second end that is attached to the lower surface 93 of housing of automatic house vent circuit breaker 50. The first end of pivoting catch arm 59 is pivotally attached to pivoting catch arm pivot pin 60. Pivoting catch arm 59 pivots about pivoting catch arm pivot pin 60 wherein pivoting catch arm 59 has first position and a second position. Pivoting electrical contact spring 57 is a spring with a first end and a second end. The first end of pivoting electrical contact spring 57 is attached to the middle section of pivoting catch arm 59. The second end of pivoting electrical contact spring 57 is attached to the middle section of pivoting electrical contact 55. Pivoting electrical contact spring 57 is continuously under tension when circuit breaker switch 53 is in all positions. This tension continuously pulls the second end of pivoting catch arm 59 towards the rear surface 91 of automatic house vent circuit breaker 50 when circuit breaker switch 53 is in all three positions: circuit closed, circuit open, and a circuit tripped.

Conversely, the tension applied by the pivoting electrical contact spring 57 pulls the second end of pivoting electrical contact 55 towards the right surface 94 of housing of automatic house vent circuit breaker 50 when circuit breaker switch 53 is in the circuit closed position and pulls the second end of pivoting electrical contact 55 towards the left surface 95 of housing of automatic house vent circuit breaker 50 when circuit breaker switch 53 is in the circuit open position. This occurs because the pivoting electrical contact pivot point 56 shifts to one side of pivoting electrical contact spring 57 when circuit breaker switch 53 is in the circuit closed position and to the other side of pivoting electrical contact spring 57 when circuit breaker switch 53 is in the circuit open position. This causes the second end of pivoting electrical contact 55 to pivot into contact with the load wire input terminal 51 when circuit breaker switch 53 is in the circuit closed position and causes the second end of pivoting electrical contact 55 to pivot away from contact with load wire input terminal 51 when circuit breaker switch 53 is in the circuit open position.

The linked pivoting actions of the circuit breaker switch 53, pivoting electrical contact 55, and pivoting catch arm 59 are a complex series that is the basis of all circuit breaker devices. The complex linked pivoting actions of the circuit breaker switch 53, pivoting electrical contact 55, and pivoting catch arm 59 yield the circuit closed, circuit open, and circuit tripped positions of the automatic house vent circuit breaker 50.

Pivoting electrical contact wire 58 is an electrical wire with a first end and a second end and electrical continuity therebetween. The first end of pivoting electrical contact wire 58 is connected to the middle section of pivoting electrical contact 55 so that there is electrical continuity between these members. The second end of pivoting electrical contact wire 58 is connected to the second end of bimetal strip 62 so that there is electrical continuity between these members.

Bimetal strip electrical bridge 67 is a rigid oblong member with a first end and a second end. Bimetal strip electrical bridge 67 is made from electrically conductive material such as metal. The first end of bimetal strip electrical bridge 67 is connected to the first end of bimetal strip 62 so that there is electrical continuity between these members at the bimetal strip pivot point 65. Bimetal strip pivot point 65 is the junction point between bimetal strip 62 and bimetal strip electrical bridge 67 and is fixed point from which bimetal strip 62 pivots about when bimetal strip 62 heats up and curls.

Bimetal strip 62 is an oblong member with a first end, a middle section, and a second end. Bimetal strip 62 is conductive. Bimetal strip 62 is a bimetallic strip that functions to convert a temperature change into mechanical displacement. Bimetal strip 62 consists of two strips of different metals that expand at different rates as they are heated which causes the bimetal strip 62 to curl or bend when heated and return to the straight position when the heat is removed. The first end of bimetal strip 62 is rigidly attached to the front surface of 90 automatic house vent circuit breaker 50 at bimetal strip pivot point 65. The second end of bimetal strip 62 pivots about the first end of bimetal strip 62 at bimetal strip pivot point 65. The first end of bimetal strip 62 remains fixed at bimetal strip pivot point 65 as the second end of bimetal strip 62 curls or pivots. Bimetal strip spring 66 is a spring with a first end and a second end. The first end of bimetal strip spring 66 is attached to the front surface of 90 automatic house vent circuit breaker 50. The second end of bimetal strip spring 66 is attached to the middle section of bimetal strip 62. Bimetal strip spring 66 functions to apply continuous bias or tension to pull the second end of bimetal strip 62 towards the right surface 94 and front surface 90 of automatic house vent circuit breaker 50. The middle section of bimetal strip 62 has a notch or aperture that functions to catch and hold the second end of pivoting catch arm 59 within the notch or aperture. Tension applied by pivoting electrical contact spring 57 holds the second end of pivoting catch arm 59 within the notch or aperture on bimetal strip 62 when circuit breaker switch 53 is in the circuit closed position and in the circuit open position.

When circuit breaker switch 53 is in the circuit closed position and automatic house vent circuit breaker 50 is in use, there is electric current flowing along the length of bimetal strip 62. During a large increase in current or a current surge, temperature of the bimetal strip 62 will increase, which in turn causes the bimetal strip 62 to curl or pivot towards the left surface 95 of automatic house vent circuit breaker 50. This curling of the bimetal strip 62 causes the second end of pivoting catch arm 59 to fall out of the notch or aperture on bimetal strip 62 and to be pulled toward the rear surface 91 of automatic house vent circuit breaker 50 by tension from the pivoting electrical contact spring 57. This is the circuit tripped condition. A particular bimetal strip 62 is engineered or designed for a certain maximum current load, such as 15 amps. A 15 amp bimetal strip 62 would then remain straight when passing electrical current below 15 amps but would curl or pivot when passing current above 15 amps. As soon as the bimetal strip 62 curls, the circuit is tripped, and automatic house vent circuit breaker 50 disconnects all electrical current through the circuit.

When circuit breaker switch 53 is in the circuit tripped position, the second end of pivoting catch arm 59 is pushed out of the notch or aperture on bimetal strip 62 so the second end of pivoting catch arm 59 is pulled toward the rear surface 91 of automatic house vent circuit breaker 50 by tension from the pivoting electrical contact spring 57. This causes the second end of circuit breaker switch 53 to pivot towards the left surface 95 of automatic house vent circuit breaker 50 because pivoting electrical contact spring 57 is connected to pivoting catch arm 59 and pivoting electrical contact 55, which is connected to circuit breaker switch 53. This causes the pivoting electrical contact pivot point 56 to pivot or move towards the left surface 95 of automatic house vent circuit breaker 50. This shift also causes the first end of pivoting electrical contact spring 57 to also pivot towards the left surface 95 of automatic house vent circuit breaker 50 because it is attached to the middle section of pivoting catch arm 59. When pivoting electrical contact pivot point 56 is in this shifted position, this causes the second end of pivoting electrical contact 55 to pivot towards the left surface 95 of automatic house vent circuit breaker 50 and removed from contact with load wire input terminal 51. The second end of pivoting electrical contact 55 pivots towards the left surface 95 of automatic house vent circuit breaker 50 because pivoting electrical contact spring 57 is positioned to the left of pivoting electrical contact pivot point 56 and consequently pulls the second end that way.

Load wire input to circuit board 70 is an electrical wire with a first end and a second end and electrical continuity therebetween. The first end of load wire input to circuit board 70 is connected to the second end of bimetal strip electrical bridge 67 so that there is electrical continuity between these members. The second end of load wire input to circuit board 70 is connected to circuit board 68 so that there is electrical continuity between these members. Neutral wire input to circuit board 71 is an electrical wire with a first end and a second end and electrical continuity therebetween. The first end of neutral wire input to circuit board 71 is connected to neutral wire input terminal 52 so that there is electrical continuity between these members. The second end of neutral wire input to circuit board 71 is connected to circuit board 68 so that there is electrical continuity between these members.

Circuit board 68 is a printed circuit board that supports and electrically connects electronic or electrical components attached to the circuit board using conductive tracks, pads, solder, or other features etched or laminated onto the circuit board. At least one integrate circuit or chip 69 is an integrated circuit or monolithic integrated circuit, also referred to as an IC, a chip, or a microchip that is a set of electronic circuits on one small flat piece of semiconductor material. At least one integrated circuit or chip 69 is attached or connected to circuit board 68 so that there is electrical continuity therebetween.

Load wire exit terminal 82 is an electrical terminal or electrical connector that is made from conductive material such as metal. Load wire exit terminal 82 is located on left surface 95 of automatic house vent circuit breaker 50. Neutral wire exit terminal 83 is an electrical terminal or electrical connector that is made from conductive material such as metal. Neutral wire exit terminal 83 is located on left surface 95 of automatic house vent circuit breaker 50.

Load wire output from circuit board 76 is an electrical wire with a first end and a second end and electrical continuity therebetween. The first end of load wire output from circuit board 76 is connected to circuit board 68 so that there is electrical continuity between these members. The second end of load wire output from circuit board 76 is connected to load wire exit terminal 82 so that there is electrical continuity between these members. Neutral wire output from circuit board 77 is an electrical wire with a first end and a second end and electrical continuity therebetween. The first end of neutral wire output from circuit board 77 is connected to circuit board 68 so that there is electrical continuity between these members. The second end of neutral wire output from circuit board 77 is connected to neutral wire exit terminal 83 so that there is electrical continuity between these members. Circuit board 68 is designed so that electrical continuity exists between load wire input to circuit board 70 and load wire output from circuit board 76. Circuit board 68 is designed so that electrical continuity exists between neutral wire input to circuit board 71 and neutral wire output from circuit board 77.

When circuit breaker switch 53 is in the circuit closed position, the second end of pivoting catch arm 59 is held or pinned within the notch or aperture on bimetal strip 62 from tension applied by pivoting electrical contact spring 57. In the circuit closed position, the second end of pivoting electrical contact 55 is held or pinned against load wire input terminal 51 to create electrical continuity therebetween. When circuit breaker switch 53 is in the circuit closed position, there is electrical continuity between load wire input terminal 51 and load wire exit terminal 82.

When circuit breaker switch 53 is in the circuit open position, the second end of pivoting catch arm 59 is held or pinned within the notch or aperture on bimetal strip 62 from tension applied by pivoting electrical contact spring 57. In the circuit open position, the second end of pivoting electrical contact 55 pivoted away from load wire input terminal 51 and does not contact load wire input terminal 51. When circuit breaker switch 53 is in the circuit open position, there is no electrical continuity between load wire input terminal 51 and pivoting electrical contact 55 and hence there is no electrical continuity between load wire input terminal 51 and load wire exit terminal 82.

When circuit breaker switch 53 is in the circuit tripped position, the second end of pivoting catch arm 59 is pushed out of the notch or aperture on bimetal strip 62 and is pulled toward the rear surface 91 of automatic house vent circuit breaker 50. This causes the second end of pivoting electrical contact 55 to pivot towards the left surface 95 of automatic house vent circuit breaker 50 and out of contact with load wire input terminal 51. When circuit breaker switch 53 is in the circuit tripped position, there is no electrical continuity between load wire input terminal 51 and pivoting electrical contact 55 and hence there is no electrical continuity between load wire input terminal 51 and load wire exit terminal 82.

After circuit breaker switch 53 has been tripped or is in the circuit tripped position, circuit breaker switch 53 rests or lies in a middle position that is in between the circuit open position and circuit closed position. In this position, the second end of pivoting electrical contact is not in contact with load wire input terminal 51 to disallow current flow within the circuit. In the tripped position, the circuit breaker switch 53 is in a permanent open position where electrical current cannot flow through the circuit. The circuit breaker switch 53 must be reset in order to close the circuit and energize the circuit again.

Pivoting catch arm stop pin 61 is used to help reset circuit breaker switch 53 after circuit breaker switch 53 has been tripped or is in the circuit tripped position. Pivoting catch arm stop pin 61 is a rigid vertical cylindrical member attached to the middle section of pivoting electrical contact 55. Pivoting catch arm stop pin 61 is perpendicular to the U-shaped member of pivoting electrical contact 55. Pivoting catch arm stop pin 61 is stationary to or with pivoting electrical contact 55 so pivoting catch arm stop pin 61 pivots or moves with pivoting electrical contact 55 as pivoting electrical contact 55 pivots or moves.

There is a two-step process to reset circuit breaker switch 53. First, the first end of circuit breaker switch 53 is be pushed or pivoted towards the left surface 95 of automatic house vent circuit breaker 50 to hear a click which places circuit breaker switch 53 in the circuit open position. Second, the first end of circuit breaker switch 53 must be pushed or pivoted towards the right surface 94 of automatic house vent circuit breaker 50 to hear a click which places circuit breaker switch 53 in the circuit closed position. This resets the circuit breaker switch 53 and places it in the closed circuit position.

The first pivot to place circuit breaker switch 53 in the open position causes the second end of circuit breaker switch 53 to pivot towards the right surface 94 of automatic house vent circuit breaker 50. This causes the second end of circuit breaker switch 53 to pivot into or make contact with pivoting catch arm stop pin 61 which causes the whole pivoting catch arm 59 to pivot or move towards the right surface 94 of automatic house vent circuit breaker 50 along with the second end of circuit breaker switch 53. This causes the second end of pivoting catch arm 59 to pivot or move towards the front surface 90 of automatic house vent circuit breaker 50 so that the second end of pivoting catch arm 59 contacts and slides along the second end of bimetal strip 62 and then falls into a notch or aperture on the middle section of bimetal strip 62. When second end of pivoting catch arm 59 reseats into the notch or aperture, a clicking sound is made, which marks the circuit open position.

The second pivot to place circuit breaker switch 53 in the closed position causes the second end of circuit breaker switch 53 to pivot or move towards the left surface 95 of housing of automatic house vent circuit breaker 50, causing the first end of pivoting electrical contact 55 to also pivot or move towards the left surface 95 of housing of automatic house vent circuit breaker 50, causing the second end of pivoting electrical contact 55 to pivot or move towards the right surface 94 of housing of automatic house vent circuit breaker 50 and to come into contact with load wire input terminal 51.

Circuit breaker solenoid 72 is an electromechanical solenoid that moves an armature into an extended position and/or retracts the armature into a retracted position by electrifying an inductive coil. Electrical current passing through an inductive coil creates an inductive force that acts upon the conductive armature located in the center of the inductive coil. The armature is positioned inside of the inductive coil where the armature may be extended or retracted by controlling the amount of electrical current passing through the inductive oil. Circuit breaker solenoid 72 may be any known type of electromechanical solenoid. Circuit breaker solenoid 72 comprises: a circuit breaker solenoid inductive coil 73, a circuit breaker solenoid armature 74, and a circuit breaker solenoid extension bracket 75. Circuit breaker solenoid inductive coil 73 is a cylindrical coil of metallic conductive wire with a first end and a second end. Circuit breaker solenoid inductive coil 73 has a hollow interior space at the center of the cylindrical member and a longitudinal axis. Circuit breaker solenoid inductive coil 73 consists of a large number of coils of metallic conductive wire. The first and second ends of circuit breaker solenoid inductive coil 73 are each attached to circuit board 68 so that there is electrical continuity between these members. Circuit breaker solenoid armature 74 is a rigid cylindrical member with a first end, a second end, and a longitudinal axis. Circuit breaker solenoid armature 74 is made of conductive material such as metal. Circuit breaker solenoid armature 74 is slideably attached inside of circuit breaker solenoid inductive coil 73 and with longitudinal axis parallel to that of circuit breaker solenoid inductive coil 73. The first end of circuit breaker solenoid armature 74 is located in the center of circuit breaker solenoid inductive coil 73. The second end of circuit breaker solenoid armature 74 protrudes out of the second end of circuit breaker solenoid inductive coil 73. Circuit breaker solenoid 72 is a "normally closed" electromechanical solenoid which means the circuit breaker solenoid armature 74 is in the retracted position when power is not applied to the circuit breaker solenoid inductive coil 73 and the circuit breaker solenoid armature 74 extends when power is supplied to the circuit breaker solenoid inductive coil 73. Circuit breaker solenoid 72 is attached to circuit board 68. At least one integrated circuit or chip 69 has electrical continuity with circuit breaker solenoid inductive coil 73. At least one integrated circuit or chip 69 is programmed with instructions or read only memory that is used to control the extension and retraction of circuit breaker solenoid armature 74. When there is loss of power or a power outage in the community, electrical power is removed or disconnected from load wire input terminal 51, which also shuts off power to the circuit board 68, integrated circuit of chip 69, and circuit breaker solenoid 72. When circuit breaker solenoid 72 experiences a loss of power, circuit breaker solenoid armature 74 automatically retracts and stays in the retracted position.

Bimetal strip extension bracket 64 is an oblong rigid bracket member with a first end and a second end. Circuit breaker solenoid extension bracket 75 is an oblong rigid bracket member with a first end and a second end. The first end of bimetal strip extension bracket 64 is rigidly attached to the second end of bimetal strip 62. The second end of bimetal strip extension bracket 64 is slideably attached to the second end of circuit breaker solenoid extension bracket 75. The first end of circuit breaker solenoid extension bracket 75 is attached to the second end of circuit breaker solenoid armature 74.

Bimetal strip extension bracket 64 and circuit breaker solenoid extension bracket 75 together function as linkage to link the circuit breaker solenoid armature 74 to bimetal strip 62. This linkage allows movement of the circuit breaker solenoid armature 74 to translate into movement of the bimetal strip 62. As stated, when power is shut off to circuit breaker solenoid 72, circuit breaker solenoid armature 74 automatically retracts and stays in the retracted position. When circuit breaker solenoid armature 74 retracts, this linkage causes the bimetal strip 62 to pivot or move towards the left surface 95 of housing of automatic house vent circuit breaker 50 which causes the second end of pivoting catch arm 59 to fall out of the notch of aperture on bimetal strip 62 so that the second end of pivoting catch arm 59 pivots or moves towards the rear surface 91 of housing of automatic house vent circuit breaker 50 where circuit breaker switch 53 assumes the circuit tripped position. As stated above, when this happens, the second end of pivoting electrical contact 55 swings away from and out of contact with load wire input terminal 51 to yield the circuit tripped position.

Without any electrical power load supplied to load wire input terminal 51, circuit breaker solenoid 72 stays in the retracted position, which will prevent the second end of pivoting catch arm 59 from catching or reseating in the notch of aperture on bimetal strip 62, thereby preventing a circuit breaker switch reset. Without any electrical power load supplied to load wire input terminal 51, automatic house vent circuit breaker 50 may not be reset, so no electrical power can flow through the circuit. As stated above, when circuit breaker solenoid 72 does not receive power, the house vent 10 closes and remains closed until power is restored and the automatic house vent circuit breaker 50 is reset.

When power is restored to load wire input terminal 51, circuit breaker solenoid 72 moves to the extended position, which allows the second end of pivoting catch arm 59 to catch or reseat in the notch of aperture on bimetal strip 62 when the reset process is undertaken. With electrical power load supplied to load wire input terminal 51, automatic house vent circuit breaker 50 may be reset, to allow electrical power is to flow through the circuit.

Importantly, when power is restored to the house, home, or building 100, all house vents 10 remain closed until only after the automatic house vent circuit breaker 50 is manually reset. This is important because power may be restored by the authorities or power company to the house, home, or building 100 when the fire is still burning and the house, home, or building 100, which can cause the house, home or building 100 to catch fire.

Automatic house vent circuit breaker 50 may further comprise: a load bridge wire 80 and a neutral bridge wire 81. In these modes, load bridge wire 80 provides a direct electrical connection between the second end of bimetal strip electrical bridge 67 and load wire exit terminal 82 so that there is electrical continuity between these members. In these modes, neutral bridge wire 81 provides a direct electrical connection between neutral wire input terminal 52 and neutral wire exit terminal 83 so that there is electrical continuity between these members. In these modes, when power is shut off or disconnected to automatic house vent circuit breaker 50, power is also shut off or disconnected to all vent solenoids 30 and vent solenoid inductive coils 32, thereby closing all house vents 10, without the need for any commands from integrated circuit or chip 69. These modes are depicted in FIGS. 13-21. This embodiment simply adds a load bridge wire 80 and a neutral bridge wire to the previous embodiment. This embodiment is an add-on and does not detract or remove anything from the previous embodiment.

Figure 13:
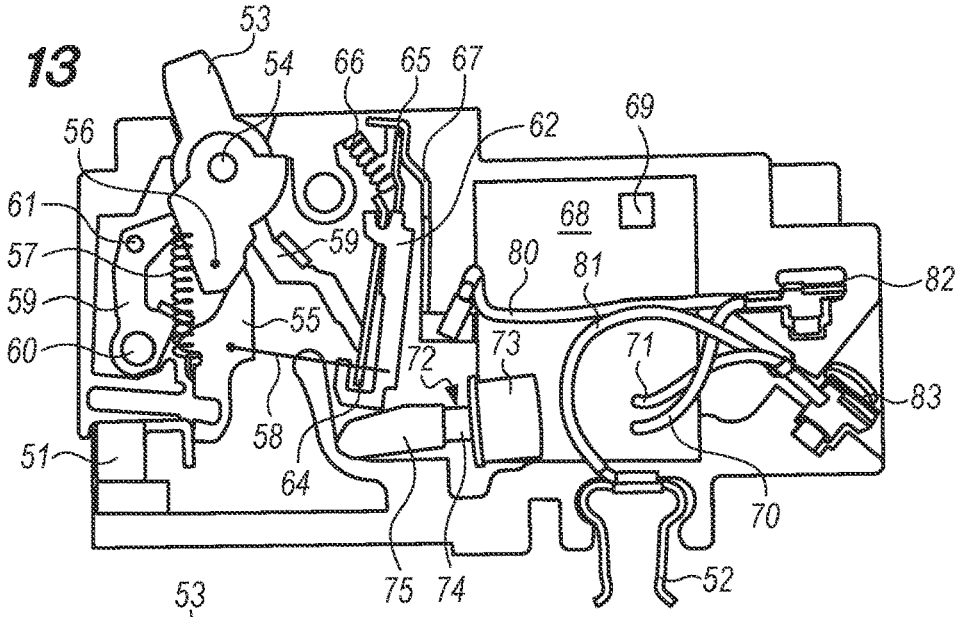
FIG. 13 a cutaway view of the inside of a second mode of automatic house vent circuit breaker with circuit breaker switch in the circuit closed position.
Figure 14:
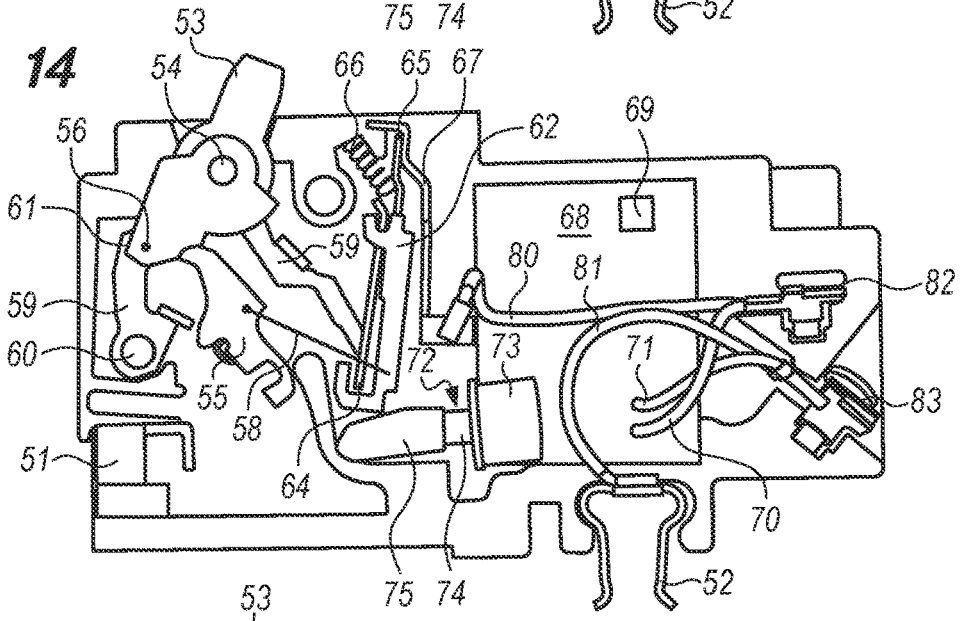
FIG. 14 a cutaway view of the inside of a second mode of automatic house vent circuit breaker with circuit breaker switch in the circuit open position.
Figure 15:
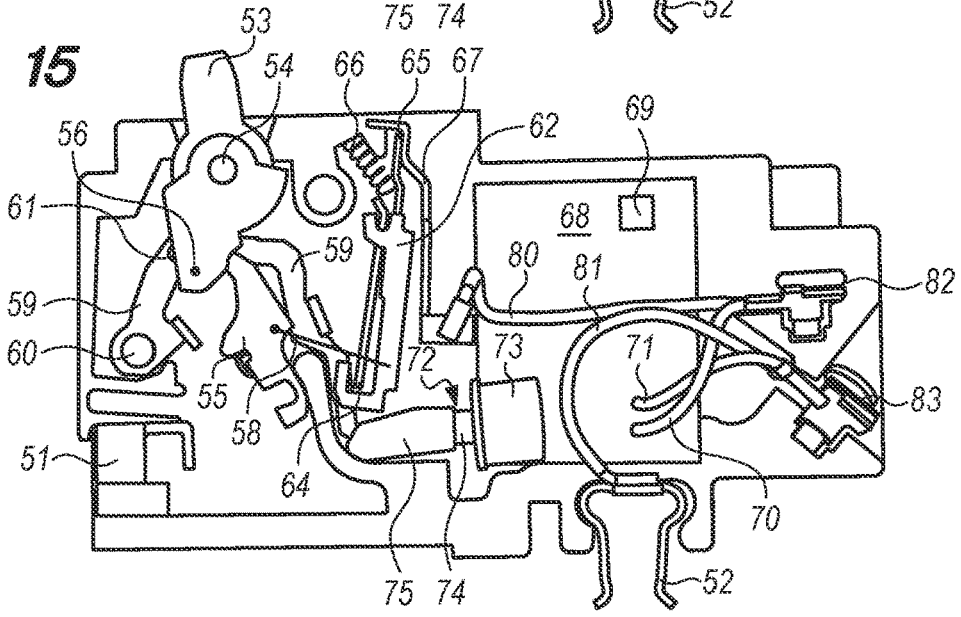
FIG. 15 a cutaway view of the inside of a second mode of automatic house vent circuit breaker with circuit breaker switch in the circuit tripped position.

Load bridge wire 80 is an electrical wire with a first end and a second end and electrical continuity therebetween. The first end of load bridge wire 80 is connected to the second end of bimetal strip electrical bridge 67 so that there is electrical continuity between these members. The second end of load bridge wire 80 is connected to load wire exit terminal 82 so that there is electrical continuity between these members. The second direct electrical connection is provided by neutral bridge wire 81. Neutral bridge wire 81 is an electrical wire with a first end and a second end and electrical continuity therebetween. The first end of neutral bridge wire 81 is connected to neutral wire input terminal 52 so that there is electrical continuity between these members. The second end of neutral bridge wire 81 is connected to neutral wire exit terminal 83 so that there is electrical continuity between these members. In this mode, the first end of load wire input to circuit board 70 is connected to load wire exit terminal 82 so that there is electrical continuity between these members, and the second end of load wire input to circuit board 70 is connected to circuit board 68 so that there is electrical continuity between these members. This mode is depicted in FIGS. 13-15.

Figure 16:
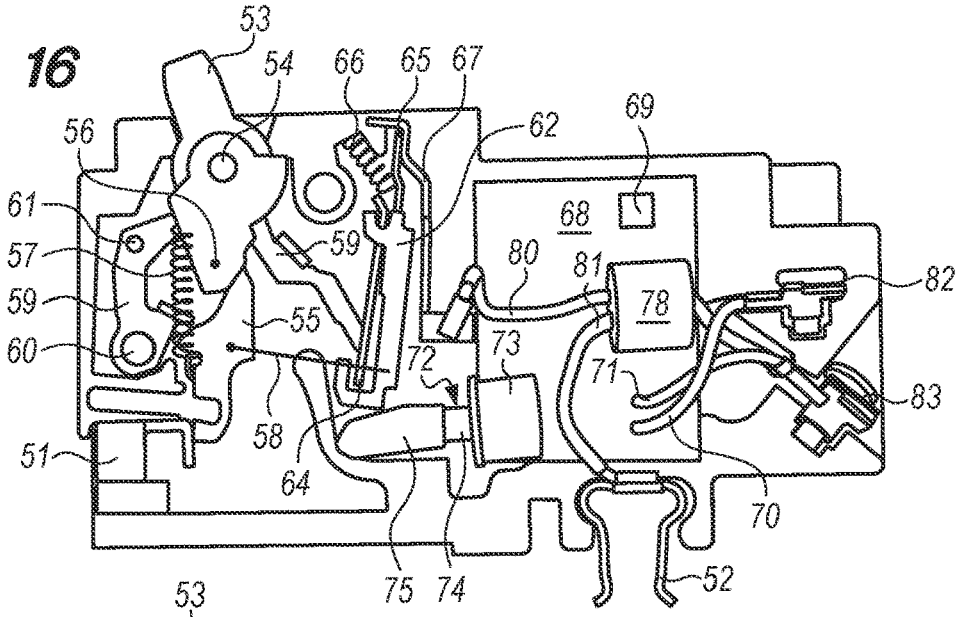
FIG. 16 a cutaway view of the inside of a third mode of automatic house vent circuit breaker with circuit breaker switch in the circuit closed position.
Figure 17:
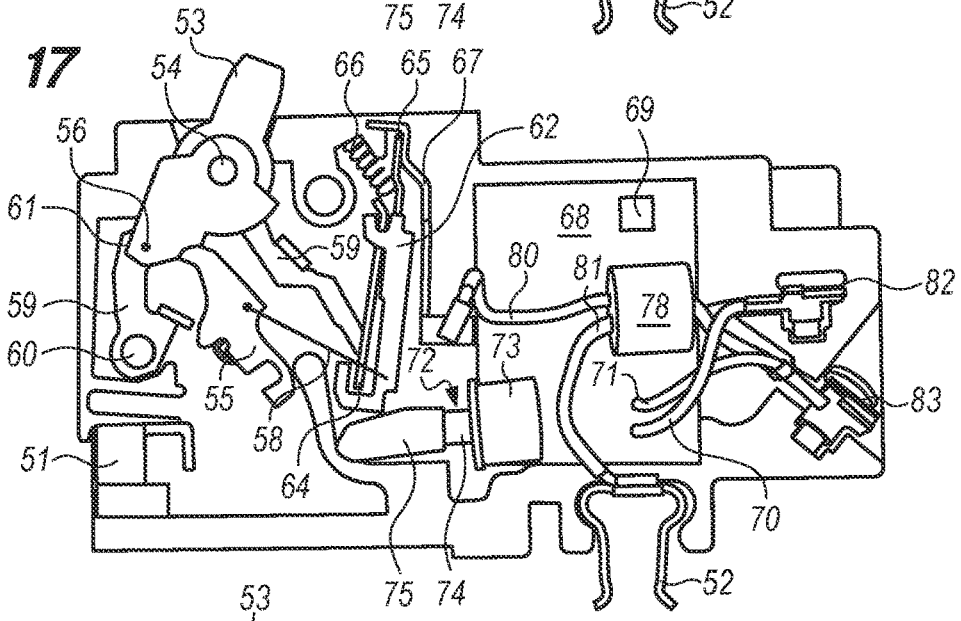
FIG. 17 a cutaway view of the inside of a third mode of automatic house vent circuit breaker with circuit breaker switch in the circuit open position.
Figure 18:
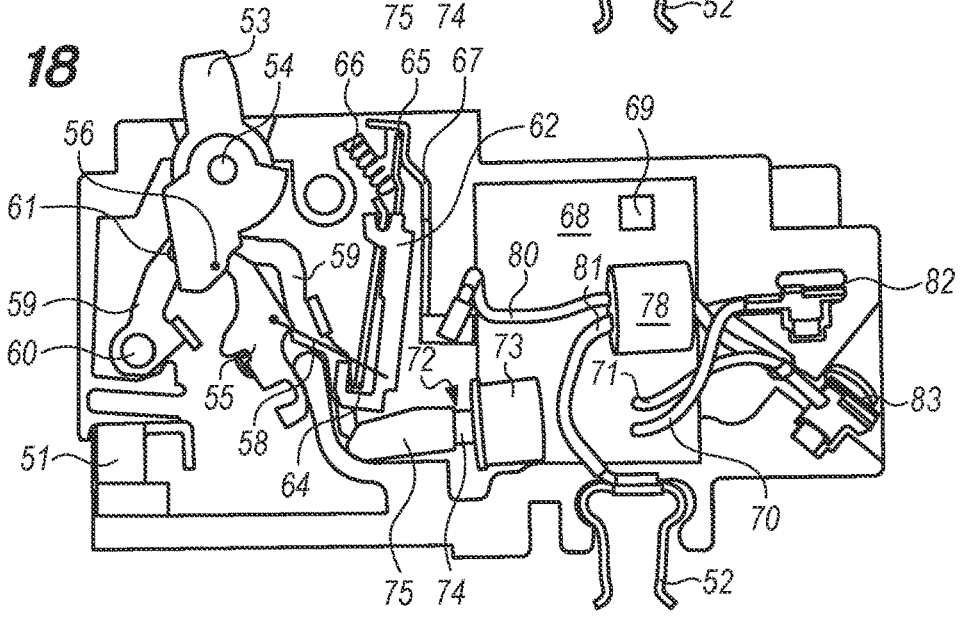
FIG. 18 a cutaway view of the inside of a third mode of automatic house vent circuit breaker with circuit breaker switch in the circuit tripped position.

Automatic house vent circuit breaker 50 may further comprise a ground fault sensor 78. This embodiment works with the preceding embodiment with a load bridge wire 80 and a neutral bridge wire 81. This embodiment may or may not include an arc fault sensor 79. Ground fault sensor 78 is a ground fault sensor that functions to simultaneously monitor, measure, or analyze the electrical current flowing along the load bridge wire 80 and the neutral bridge wire 81 and detect when there is disequilibrium between these two currents and then sets off an alarm signal when this occurs. Any known type of ground fault sensor may be used. Ground fault sensor 78 is attached to circuit board 68 with electrical continuity between these members. Load bridge wire 80 physically passes through ground fault sensor 78 so that ground fault sensor 78 can measure the electrical current passing through load bridge wire 80. Neutral bridge wire 81 also physically passes through ground fault sensor 78 so that ground fault sensor 78 can measure the electrical current passing through neutral bridge wire 81. When ground fault sensor 78 senses an unequal current between load bridge wire 80 and neutral bridge wire 81, this means that there is a ground fault condition or electrical short circuit between these wires 80,81. When this occurs, ground fault sensor 78 sends an electrical signal to at least one integrated circuit or chip 69 which is programmed to then instruct or command circuit breaker solenoid 72 to extend the circuit breaker solenoid armature 74, thereby causing circuit breaker switch 53 to fall into the circuit tripped position. This mode is depicted in FIGS. 16-18.

Figure 19:
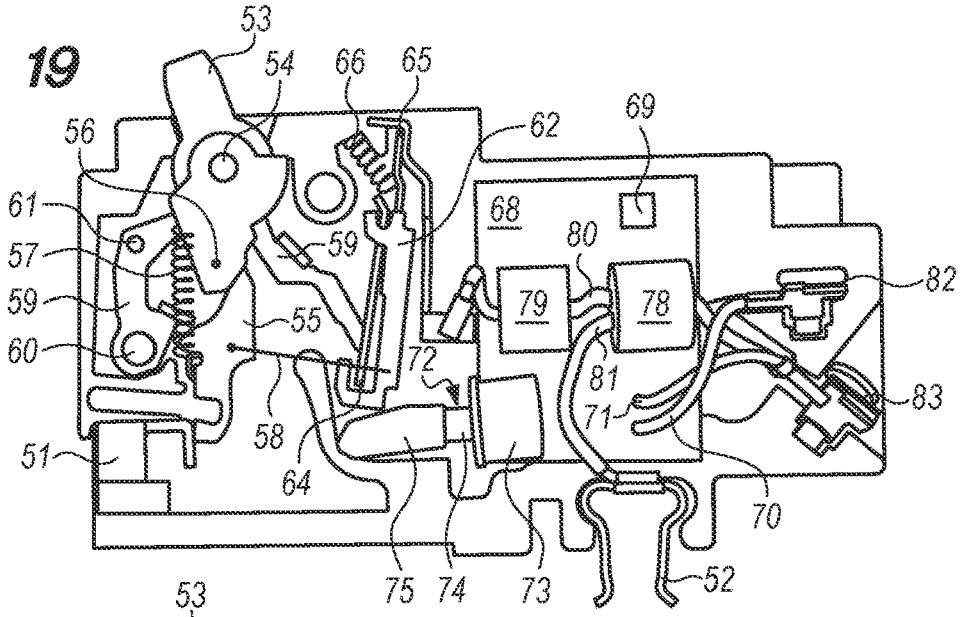
FIG. 19 a cutaway view of the inside of a fourth mode of automatic house vent circuit breaker with circuit breaker switch in the circuit closed position.
Figure 20:
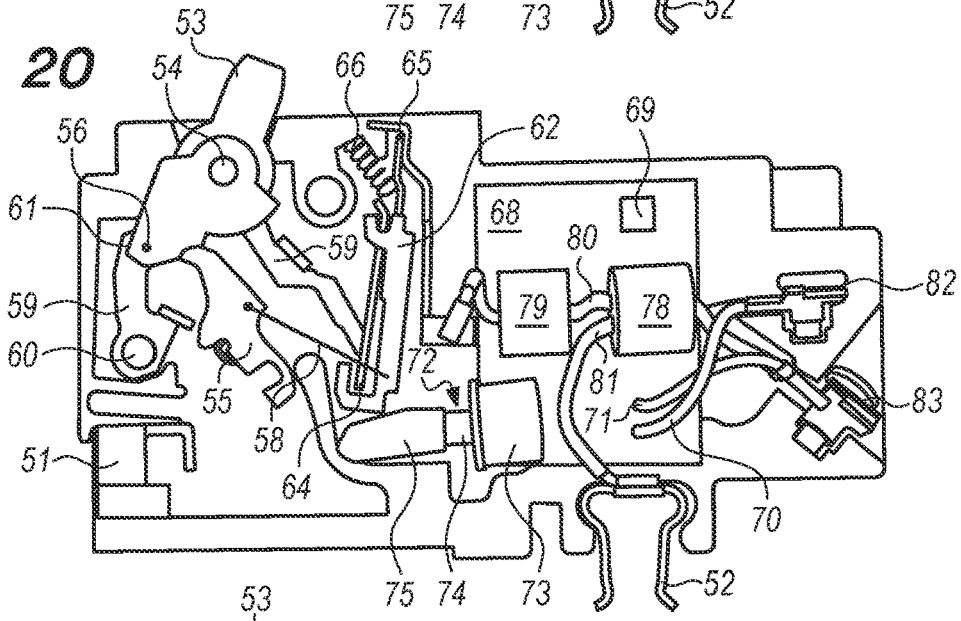
FIG. 20 a cutaway view of the inside of a fourth mode of automatic house vent circuit breaker with circuit breaker switch in the circuit open position.
Figure 21:
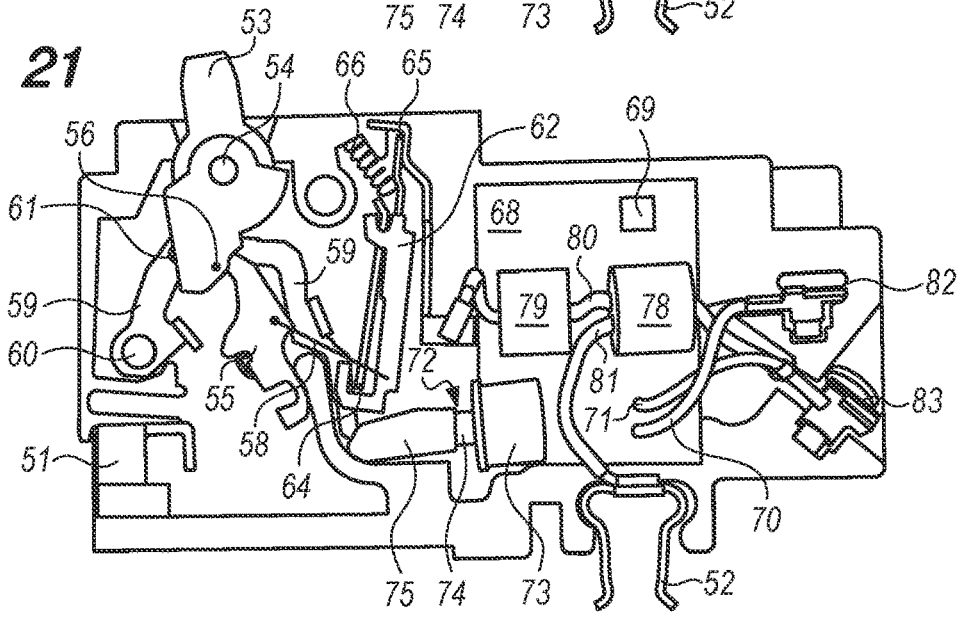
FIG. 21 a cutaway view of the inside of a fourth mode of automatic house vent circuit breaker with circuit breaker switch in the circuit tripped position.
Figure 22:
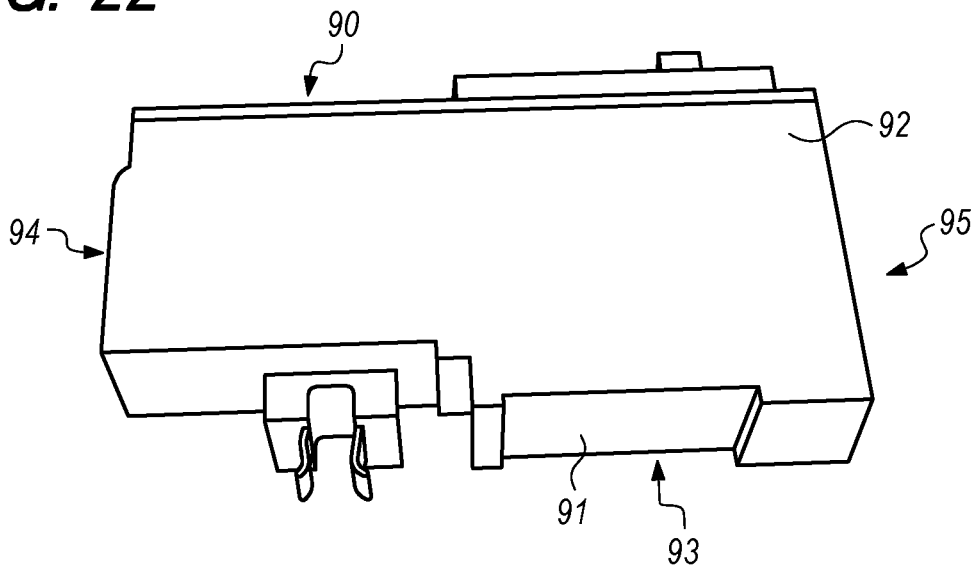
FIG. 22 is a front perspective view of automatic house vent circuit breaker.
Figure 23:
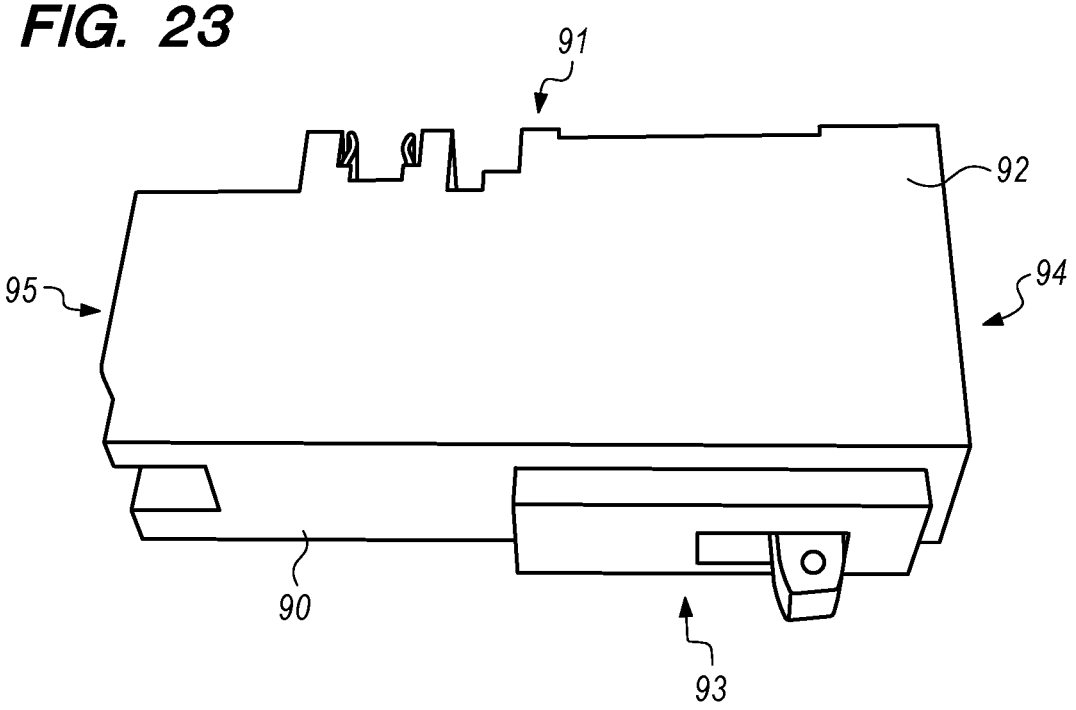
FIG. 23 is a rear perspective view of automatic house vent circuit breaker.

Automatic house vent circuit breaker 50 may further comprise an arc fault sensor 79. This embodiment works with the preceding embodiment with a load bridge wire 80 and a neutral bridge wire 81. This embodiment may or may not include a ground fault sensor 78. Arc fault sensor 79 is an arc fault sensor that functions to monitor, measure, or analyze the electrical current flowing along the load bridge wire 80 and detect when there is an electrical signal or oscilloscope reading from the electrical current flowing along the load bridge wire 80 that typically results from an arc fault or electrical short and then sets off an alarm signal when this occurs. Any known type of ground arc sensor may be used. Arc fault sensor 79 is attached to circuit board 68 with electrical continuity between these members. Load bridge wire 80 physically passes through arc fault sensor 79 so that arc fault sensor 79 can monitor the electrical current passing through load bridge wire 80. When arc fault sensor 79 senses a current reading or signal that is indicative a ground fault or short circuit, then arc fault sensor 79 sends an electrical signal to at least one integrated circuit or chip 69 which is programmed to then instruct or command circuit breaker solenoid 72 to extend the circuit breaker solenoid armature 74, thereby causing circuit breaker switch 53 to fall into the circuit tripped position. This mode is depicted in FIGS. 19-21.

What is claimed is:

1. An automatic house vent comprising: at least one shutter vent; at least one vent solenoid; an automatic house vent circuit breaker; and a plurality of electrical wiring, wherein each said at least one vent solenoid is an electromechanical solenoid comprising: a vent solenoid inductive coil and a vent solenoid armature, said vent solenoid inductive coil is a cylindrical coil of metallic conductive wire with a first end, a second end, an interior, and a longitudinal axis, said vent solenoid armature is a rigid cylindrical member with a first end, a second end, and a longitudinal axis, said vent solenoid armature is made of conductive material, said vent solenoid armature is slideably attached to said interior of said vent solenoid inductive coil with said longitudinal axis of said vent solenoid armature parallel to said longitudinal axis of said vent solenoid inductive coil, said first end of said vent solenoid armature is located in said interior of said vent solenoid inductive coil, said second end of said vent solenoid armature protrudes out of said second end of said vent solenoid inductive coil, said first end of said vent solenoid inductive coil is connected to a load wire exit terminal or to a neutral wire exit terminal by said plurality of electrical wiring so that there is electrical continuity between these members, said second end of said vent solenoid inductive coil is connected to said load wire exit terminal or to said neutral wire exit terminal by said plurality of electrical wiring so that there is electrical continuity between these members, said at least one shutter vent comprises: a shutter vent frame; a plurality of pivoting shutter blades; and a shutter rod, said shutter vent frame is a rigid structural member or frame member with a left support, a right support, a top support, a bottom support, and a rectangular or square opening in the center, each of said plurality of pivoting shutter blades is a rigid rectangular planar member with an inside surface, an outside surface, a left edge, a right edge, a top edge, a bottom edge, and a longitudinal axis, each of said plurality of pivoting shutter blades is pivotally attached to said shutter vent frame, said shutter rod is a rigid vertical cylindrical member with an upper end, a middle section, a lower end, and a longitudinal axis, said lower end of said shutter rod is rigidly attached to said second end of said vent solenoid armature, said top edge of each of said plurality of pivoting shutter blades is attached to said shutter rod, said automatic house vent circuit breaker comprises: a load wire input terminal; a neutral wire input terminal; a circuit breaker switch; a circuit breaker switch pivot pin; a pivoting electrical contact; a pivoting electrical contact pivot point; a pivoting electrical contact spring; a pivoting electrical contact wire; a pivoting catch arm; a pivoting catch arm pivot pin; a pivoting catch arm stop pin; a bimetal strip; a bimetal strip extension bracket; a bimetal strip pivot point; bimetal strip spring; a bimetal strip electrical bridge; a circuit board; a load wire input; a neutral wire input; a circuit breaker solenoid; a circuit breaker solenoid extension bracket; a load wire output; a neutral wire output; said load wire exit terminal; and said neutral wire exit terminal, wherein, said automatic house vent circuit breaker has a rigid hollow casing with a front surface, a rear surface, an upper surface, a lower surface, a right surface, and a left surface, said load wire input terminal is an electrical terminal or electrical connector that is made from conductive material that is located at the intersection of said rear surface and said right surface of said automatic house vent circuit breaker, said neutral wire input terminal is an electrical terminal or electrical connector that is located on said rear surface of said automatic house vent circuit breaker, said circuit breaker switch is a rigid oblong member with a first end, a middle section, and a second end, said circuit breaker switch is located on said front surface of said automatic house vent circuit breaker, said middle section of said circuit breaker switch is pivotally attached to said circuit breaker switch pivot pin, said circuit breaker switch pivot pin is a rigid vertical cylindrical member with a first end that is attached to said upper surface and a second end that is attached to said lower surface of said automatic house vent circuit breaker, said circuit breaker switch pivots about said circuit breaker switch pivot pin, said first end of said circuit breaker switch protrudes through said front surface of said automatic house vent circuit breaker, said first end of circuit breaker switch has a circuit closed position, a circuit open position, and a circuit tripped position, said pivoting electrical contact is a rigid oblong member with a first end, a middle section, and a second end, said pivoting electrical contact is made from conductive material, said first end of said pivoting electrical contact is pivotally attached to said second end of said circuit breaker switch at said pivoting electrical contact pivot point, said pivoting electrical contact pivots about said pivoting electrical contact pivot point, said pivoting catch arm is a rigid U-shaped member wherein the open end of said rigid U-shaped member faces said rear surface of said automatic house vent circuit breaker, said pivoting catch arm has a first end, a middle section, and a second end, said pivoting catch arm pivot pin is a rigid vertical cylindrical member with a first end that is attached to said upper surface and a second end that is attached to said lower surface of said automatic house vent circuit breaker, said first end of said pivoting catch arm is pivotally attached to said pivoting catch arm pivot pin, said pivoting catch arm pivots about said pivoting catch arm pivot pin, said pivoting electrical contact spring is a spring with a first end and a second end, said first end of said pivoting electrical contact spring is attached to said middle section of said pivoting catch arm, said second end of said pivoting electrical contact spring is attached to said middle section of said pivoting electrical contact, said pivoting electrical contact wire is an electrical wire with a first end and a second end and electrical continuity therebetween, said first end of said pivoting electrical contact wire is connected to said middle section of said pivoting electrical contact so that there is electrical continuity between these members, said bimetal strip is an oblong member with a first end, a middle section, and a second end, said second end of said pivoting electrical contact wire is connected to said second end of said bimetal strip so that there is electrical continuity between these members, said bimetal strip electrical bridge is a rigid oblong member with a first end and a second end, said bimetal strip electrical bridge is made from electrically conductive material, said first end of said bimetal strip electrical bridge is connected to said first end of said bimetal strip so that there is electrical continuity between these members, said first end of said bimetal strip electrical bridge is connected to said first end of bimetal strip at said bimetal strip pivot point, said bimetal strip pivots about said bimetal strip pivot point, said bimetal strip is conductive, said bimetal strip is a bimetallic strip that consists of two strips of different metals that expand at different rates, said first end of said bimetal strip is rigidly attached to said front surface of said automatic house vent circuit breaker at said bimetal strip pivot point, said second end of said bimetal strip pivots about said first end of said bimetal strip at said bimetal strip pivot point, said bimetal strip spring is a spring with a first end and a second end, said first end of said bimetal strip spring is attached to said front surface of said automatic house vent circuit breaker, said second end of said bimetal strip spring is attached to said middle section of said bimetal strip, said middle section of said bimetal strip has a notch or an aperture that catches and holds said second end of said pivoting catch arm within said notch or aperture, said load wire input is an electrical wire with a first end and a second end and electrical continuity therebetween, said first end of said load wire input is connected to said second end of said bimetal strip electrical bridge so that there is electrical continuity between these members, said second end of said load wire input is connected to said circuit board so that there is electrical continuity between these members, said neutral wire input is an electrical wire with a first end and a second end and electrical continuity therebetween, said first end of said neutral wire input is connected to said neutral wire input terminal so that there is electrical continuity between these members, said second end of said neutral wire input is connected to said circuit board so that there is electrical continuity between these members, said circuit board is a printed circuit board that supports and electrically connects electronic or electrical components attached to said circuit board, said load wire exit terminal is an electrical terminal or electrical connector that is made from conductive material, said load wire exit terminal is located on said left surface of said automatic house vent circuit breaker, said neutral wire exit terminal is an electrical terminal or electrical connector that is made from conductive material, said neutral wire exit terminal is located on said left surface of said automatic house vent circuit breaker, said load wire output is an electrical wire with a first end and a second end and electrical continuity therebetween, said first end of said load wire output is connected to said circuit board so that there is electrical continuity between these members, said second end of said load wire output is connected to said load wire exit terminal so that there is electrical continuity between these members, said neutral wire output is an electrical wire with a first end and a second end and electrical continuity therebetween, said first end of neutral wire output is connected to said circuit board so that there is electrical continuity between these members, said second end of neutral wire output is connected to said neutral wire exit terminal so that there is electrical continuity between these members, said circuit breaker solenoid is an electromechanical solenoid comprising: a circuit breaker solenoid inductive coil, a circuit breaker solenoid armature, and a circuit breaker solenoid extension bracket, said circuit breaker solenoid inductive coil is a cylindrical coil of metallic conductive wire with a first end, a second end, an interior, and a longitudinal axis, said first and second ends of said circuit breaker solenoid inductive coil are each attached to said circuit board so that there is electrical continuity between these members, said circuit breaker solenoid armature is a rigid cylindrical member with a first end, a second end, and a longitudinal axis, said circuit breaker solenoid armature is made of conductive material, said circuit breaker solenoid armature is slideably attached to said interior of said circuit breaker solenoid inductive coil with said longitudinal axis of said circuit breaker solenoid armature parallel to said longitudinal axis of said circuit breaker solenoid inductive coil, said first end of said circuit breaker solenoid armature is located in said interior of said circuit breaker solenoid inductive coil, said second end of said circuit breaker solenoid armature protrudes out of said second end of said circuit breaker solenoid inductive coil, said bimetal strip extension bracket is an oblong rigid bracket member with a first end and a second end, said circuit breaker solenoid extension bracket is an oblong rigid bracket member with a first end and a second end, said first end of said bimetal strip extension bracket is rigidly attached to said second end of bimetal strip, said second end of said bimetal strip extension bracket is slideably attached to said second end of said circuit breaker solenoid extension bracket, said first end of said circuit breaker solenoid extension bracket is attached to said second end of said circuit breaker solenoid armature, and said bimetal strip extension bracket is linked to said circuit breaker solenoid extension bracket which is linked to said circuit breaker solenoid armature.

2. An automatic house vent as recited in claim 1 further comprising: a load bridge wire and a neutral bridge wire, wherein, said load bridge wire is an electrical wire with a first end and a second end and electrical continuity therebetween, said first end of said load bridge wire is connected to said second end of said bimetal strip electrical bridge so that there is electrical continuity between these members, said second end of said load bridge wire is connected to said load wire exit terminal so that there is electrical continuity between these members, said neutral bridge wire is an electrical wire with a first end and a second end and electrical continuity therebetween, said first end of said neutral bridge wire is connected to said neutral wire input terminal so that there is electrical continuity between these members, and said second end of said neutral bridge wire is connected to said neutral wire exit terminal so that there is electrical continuity between these members.

3. An automatic house vent as recited in claim 2 further comprising: a ground fault sensor and at least one integrated circuit or chip, wherein each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said ground fault sensor is a ground fault electrical sensor that functions to simultaneously monitor an electrical current flowing along said load bridge wire and an electrical current flowing along said neutral bridge wire, and detect when there is disequilibrium between said current flowing along said load bridge wire and said electrical current flowing along said neutral bridge wire and then sets off an alarm signal when this occurs, said ground fault sensor is attached to said circuit board with electrical continuity between these members, said load bridge wire physically passes through said ground fault sensor so that said ground fault sensor is configured to monitor the electrical current passing through said load bridge wire, and said neutral bridge wire also physically passes through said ground fault sensor so that said ground fault sensor is configured to monitor the electrical current passing through said neutral bridge wire.

4. An automatic house vent as recited in claim 2 further comprising: an arc fault sensor and at least one integrated circuit or chip, wherein, each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said arc fault sensor is an arc fault electrical sensor that functions to monitor the electrical current flowing along said load bridge wire and detect when there is an electrical signal or an oscilloscope reading from the electrical current flowing along said load bridge wire that results from an arc fault or electrical short and then sets off an alarm signal when an arc fault or electrical short occurs, said arc fault sensor is attached to said circuit board with electrical continuity between these members, and said load bridge wire physically passes through said arc fault sensor so that said arc fault sensor is configured to monitor the electrical current passing through said load bridge wire.

5. An automatic house vent comprising: at least one rectangular or square louvered vent; at least one vent solenoid; an automatic house vent circuit breaker; and a plurality of electrical wiring, wherein each said at least one vent solenoid is an electromechanical solenoid comprising: a vent solenoid inductive coil and a vent solenoid armature, said vent solenoid inductive coil is a cylindrical coil of metallic conductive wire with a first end, a second end, an interior, and a longitudinal axis, said vent solenoid armature is a rigid cylindrical member with a first end, a second end, and a longitudinal axis, said vent solenoid armature is made of conductive material, said vent solenoid armature is slideably attached to said interior of said vent solenoid inductive coil with said longitudinal axis of said vent solenoid armature parallel to said longitudinal axis of said vent solenoid inductive coil, said first end of said vent solenoid armature is located in said interior of said vent solenoid inductive coil, said second end of said vent solenoid armature protrudes out of said second end of said vent solenoid inductive coil, said first end of said vent solenoid inductive coil is connected to a load wire exit terminal or to a neutral wire exit terminal by said plurality of electrical wiring so that there is electrical continuity between these members, said second end of said vent solenoid inductive coil is connected to said load wire exit terminal or to said neutral wire exit terminal by said plurality of electrical wiring so that there is electrical continuity between these members, each said rectangular or square louvered vent comprises: a rectangular or square louvered vent frame; a first aperture sheet; a second aperture sheet, and a second aperture sheet rod, said rectangular or square louvered vent frame is a rigid structural member or frame member with a left support, a right support, a top support, a bottom support, and a rectangular or square opening in the center, said first aperture sheet is a rigid planar square or rectangular member with an inside surface, an outside surface, a left edge, a right edge, a top edge, a bottom edge, and a plurality of rectangular apertures, vents, or holes, said second aperture sheet is a rigid planar square or rectangular member with an inside surface, an outside surface, a left edge, a right edge, a top edge, a bottom edge, and a plurality of rectangular apertures, vents, or holes, said first aperture sheet is rigidly attached to said rectangular or square louvered vent frame, said second aperture sheet is slideably attached to said rectangular or square louvered vent frame, said second aperture sheet rod is a rigid cylindrical member with a first end, a middle section, a second end, and a longitudinal axis, said first end of said second aperture sheet rod is rigidly attached to said second end of said vent solenoid armature, said second end of said second aperture sheet rod is attached to said left edge, right edge, top edge, or bottom edge of said second aperture sheet, said automatic house vent circuit breaker comprises: a load wire input terminal; a neutral wire input terminal; a circuit breaker switch; a circuit breaker switch pivot pin; a pivoting electrical contact; a pivoting electrical contact pivot point; a pivoting electrical contact spring; a pivoting electrical contact wire; a pivoting catch arm; a pivoting catch arm pivot pin; a pivoting catch arm stop pin; a bimetal strip; a bimetal strip extension bracket; a bimetal strip pivot point; bimetal strip spring; a bimetal strip electrical bridge; a circuit board; a load wire input; a neutral wire input; a circuit breaker solenoid; a circuit breaker solenoid extension bracket; a load wire output; a neutral wire output; said load wire exit terminal; and said neutral wire exit terminal, wherein, said automatic house vent circuit breaker has a rigid hollow casing with a front surface, a rear surface, an upper surface, a lower surface, a right surface, and a left surface, said load wire input terminal is an electrical terminal or electrical connector that is made from conductive material that is located at the intersection of said rear surface and said right surface of said automatic house vent circuit breaker, said neutral wire input terminal is an electrical terminal or electrical connector that is located on said rear surface of said automatic house vent circuit breaker, said circuit breaker switch is a rigid oblong member with a first end, a middle section, and a second end, said circuit breaker switch is located on said front surface of said automatic house vent circuit breaker, said middle section of said circuit breaker switch is pivotally attached to said circuit breaker switch pivot pin, said circuit breaker switch pivot pin is a rigid vertical cylindrical member with a first end that is attached to said upper surface and a second end that is attached to said lower surface of said automatic house vent circuit breaker, said circuit breaker switch pivots about said circuit breaker switch pivot pin, said first end of said circuit breaker switch protrudes through said front surface of said automatic house vent circuit breaker, said first end of circuit breaker switch has a circuit closed position, a circuit open position, and a circuit tripped position, said pivoting electrical contact is a rigid oblong member with a first end, a middle section, and a second end, said pivoting electrical contact is made from conductive material, said first end of said pivoting electrical contact is pivotally attached to said second end of said circuit breaker switch at said pivoting electrical contact pivot point, said pivoting electrical contact pivots about said pivoting electrical contact pivot point, said pivoting catch arm is a rigid U-shaped member wherein the open end of said rigid U-shaped member faces said rear surface of said automatic house vent circuit breaker, said pivoting catch arm has a first end, a middle section, and a second end, said pivoting catch arm pivot pin is a rigid vertical cylindrical member with a first end that is attached to said upper surface and a second end that is attached to said lower surface of said automatic house vent circuit breaker, said first end of said pivoting catch arm is pivotally attached to said pivoting catch arm pivot pin, said pivoting catch arm pivots about said pivoting catch arm pivot pin, said pivoting electrical contact spring is a spring with a first end and a second end, said first end of said pivoting electrical contact spring is attached to said middle section of said pivoting catch arm, said second end of said pivoting electrical contact spring is attached to said middle section of said pivoting electrical contact, said pivoting electrical contact wire is an electrical wire with a first end and a second end and electrical continuity therebetween, said first end of said pivoting electrical contact wire is connected to said middle section of said pivoting electrical contact so that there is electrical continuity between these members, said bimetal strip is an oblong member with a first end, a middle section, and a second end, said second end of said pivoting electrical contact wire is connected to said second end of said bimetal strip so that there is electrical continuity between these members, said bimetal strip electrical bridge is a rigid oblong member with a first end and a second end, said bimetal strip electrical bridge is made from electrically conductive material, said first end of said bimetal strip electrical bridge is connected to said first end of said bimetal strip so that there is electrical continuity between these members, said first end of said bimetal strip electrical bridge is connected to said first end of bimetal strip at said bimetal strip pivot point, said bimetal strip pivots about said bimetal strip pivot point, said bimetal strip is conductive, said bimetal strip is a bimetallic strip that consists of two strips of different metals that expand at different rates, said first end of said bimetal strip is rigidly attached to said front surface of said automatic house vent circuit breaker at said bimetal strip pivot point, said second end of said bimetal strip pivots about said first end of said bimetal strip at said bimetal strip pivot point, said bimetal strip spring is a spring with a first end and a second end, said first end of said bimetal strip spring is attached to said front surface of said automatic house vent circuit breaker, said second end of said bimetal strip spring is attached to said middle section of said bimetal strip, said middle section of said bimetal strip has a notch or an aperture that catches and holds said second end of said pivoting catch arm within said notch or aperture, said load wire input is an electrical wire with a first end and a second end and electrical continuity therebetween, said first end of said load wire input is connected to said second end of said bimetal strip electrical bridge so that there is electrical continuity between these members, said second end of said load wire input is connected to said circuit board so that there is electrical continuity between these members, said neutral wire input to circuit board is an electrical wire with a first end and a second end and electrical continuity therebetween, said first end of said neutral wire input is connected to said neutral wire input terminal so that there is electrical continuity between these members, said second end of said neutral wire input is connected to said circuit board so that there is electrical continuity between these members, said circuit board is a printed circuit board that supports and electrically connects electronic or electrical components attached to said circuit board, said load wire exit terminal is an electrical terminal or electrical connector that is made from conductive material, said load wire exit terminal is located on said left surface of said automatic house vent circuit breaker, said neutral wire exit terminal is an electrical terminal or electrical connector that is made from conductive material, said neutral wire exit terminal is located on said left surface of said automatic house vent circuit breaker, said load wire output is an electrical wire with a first end and a second end and electrical continuity therebetween, said first end of said load wire output is connected to said circuit board so that there is electrical continuity between these members, said second end of said load wire output is connected to said load wire exit terminal so that there is electrical continuity between these members, said neutral wire output is an electrical wire with a first end and a second end and electrical continuity therebetween, said first end of neutral wire output is connected to said circuit board so that there is electrical continuity between these members, said second end of neutral wire output is connected to said neutral wire exit terminal so that there is electrical continuity between these members, said circuit breaker solenoid is an electromechanical solenoid comprising: a circuit breaker solenoid inductive coil, a circuit breaker solenoid armature, and a circuit breaker solenoid extension bracket, said circuit breaker solenoid inductive coil is a cylindrical coil of metallic conductive wire with a first end, a second end, an interior, and a longitudinal axis, said first and second ends of said circuit breaker solenoid inductive coil are each attached to said circuit board so that there is electrical continuity between these members, said circuit breaker solenoid armature is a rigid cylindrical member with a first end, a second end, and a longitudinal axis, said circuit breaker solenoid armature is made of conductive material, said circuit breaker solenoid armature is slideably attached to said interior of said circuit breaker solenoid inductive coil with said longitudinal axis of said circuit breaker solenoid armature parallel to said longitudinal axis of said circuit breaker solenoid inductive coil, said first end of said circuit breaker solenoid armature is located in said interior of said circuit breaker solenoid inductive coil, said second end of said circuit breaker solenoid armature protrudes out of said second end of said circuit breaker solenoid inductive coil, said bimetal strip extension bracket is an oblong rigid bracket member with a first end and a second end, said circuit breaker solenoid extension bracket is an oblong rigid bracket member with a first end and a second end, said first end of said bimetal strip extension bracket is rigidly attached to said second end of bimetal strip, said second end of said bimetal strip extension bracket is slideably attached to said second end of said circuit breaker solenoid extension bracket, said first end of said circuit breaker solenoid extension bracket is attached to said second end of said circuit breaker solenoid armature, and said bimetal strip extension bracket is linked to said circuit breaker solenoid extension bracket which is linked to said circuit breaker solenoid armature.

6. An automatic house vent as recited in claim 5 further comprising: a load bridge wire and a neutral bridge wire, wherein, said load bridge wire is an electrical wire with a first end and a second end and electrical continuity therebetween, said first end of said load bridge wire is connected to said second end of said bimetal strip electrical bridge so that there is electrical continuity between these members, said second end of said load bridge wire is connected to said load wire exit terminal so that there is electrical continuity between these members, said neutral bridge wire is an electrical wire with a first end and a second end and electrical continuity therebetween, said first end of said neutral bridge wire is connected to said neutral wire input terminal so that there is electrical continuity between these members, and said second end of said neutral bridge wire is connected to said neutral wire exit terminal so that there is electrical continuity between these members.

7. An automatic house vent as recited in claim 6 further comprising: a ground fault sensor and at least one integrated circuit or chip, wherein, each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said ground fault sensor is a ground fault electrical sensor that functions to simultaneously monitor an electrical current flowing along said load bridge wire and an electrical current flowing along said neutral bridge wire, and detect when there is disequilibrium between said current flowing along said load bridge wire and said electrical current flowing along said neutral bridge wire and then sets off an alarm signal when this occurs, said ground fault sensor is attached to said circuit board with electrical continuity between these members, said load bridge wire physically passes through said ground fault sensor so that said ground fault sensor is configured to monitor the electrical current passing through said load bridge wire, and said neutral bridge wire also physically passes through said ground fault sensor so that said ground fault sensor is configured to monitor the electrical current passing through said neutral bridge wire.

8. An automatic house vent as recited in claim 6 further comprising: an arc fault sensor and at least one integrated circuit or chip, wherein, each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said arc fault sensor is an arc fault electrical sensor that functions to monitor the electrical current flowing along said load bridge wire and detect when there is an electrical signal or an oscilloscope reading from the electrical current flowing along said load bridge wire that results from an arc fault or electrical short and then sets off an alarm signal when an arc fault or electrical short occurs, said arc fault sensor is attached to said circuit board with electrical continuity between these members, and said load bridge wire physically passes through said arc fault sensor so that said arc fault sensor is configured to monitor the electrical current passing through said load bridge wire.

9. An automatic house vent comprising: at least one round louvered vent; at least one vent solenoid; an automatic house vent circuit breaker; and a plurality of electrical wiring, wherein each said at least one vent solenoid is an electromechanical solenoid comprising: a vent solenoid inductive coil and a vent solenoid armature, said vent solenoid inductive coil is a cylindrical coil of metallic conductive wire with a first end, a second end, an interior, and a longitudinal axis, said vent solenoid armature is a rigid cylindrical member with a first end, a second end, and a longitudinal axis, said vent solenoid armature is made of conductive material, said vent solenoid armature is slideably attached to said interior of said vent solenoid inductive coil with said longitudinal axis of said vent solenoid armature parallel to said longitudinal axis of said vent solenoid inductive coil, said first end of said vent solenoid armature is located in said interior of said vent solenoid inductive coil, said second end of said vent solenoid armature protrudes out of said second end of said vent solenoid inductive coil, said first end of said vent solenoid inductive coil is connected to a load wire exit terminal or to a neutral wire exit terminal by said plurality of electrical wiring so that there is electrical continuity between these members, said second end of said vent solenoid inductive coil is connected to said load wire exit terminal or to said neutral wire exit terminal by said plurality of electrical wiring so that there is electrical continuity between these members, each round louvered vent comprises: a first round aperture sheet; a second round aperture sheet; a second round aperture sheet rod; and a round louvered vent frame, said round louvered vent frame is a rigid circular structural member or frame member with a center and a circular opening in the center, said first round aperture sheet is a rigid planar circular member with an inside surface, an outside surface, a center, a circumference edge, and a plurality of apertures, vents, or holes, said second round aperture sheet is a rigid planar circular member with an inside surface, an outside surface, a center, a circumference edge, and a plurality of apertures, vents, or holes, said first round aperture sheet is rigidly attached to said round louvered vent frame, said second round aperture sheet is pivotally attached to said round louvered vent frame, said centers of said first and second round aperture sheets are coincident with said center of said round louvered vent frame, said second round aperture sheet rod is a rigid cylindrical member with a first end, a middle section, a second end, and a longitudinal axis, said first end of said second round aperture sheet rod is rigidly attached to said second end of said vent solenoid armature, said second end of said second aperture sheet rod is attached to said circumference edge of said second round aperture sheet, said automatic house vent circuit breaker comprises: a load wire input terminal; a neutral wire input terminal; a circuit breaker switch; a circuit breaker switch pivot pin; a pivoting electrical contact; a pivoting electrical contact pivot point; a pivoting electrical contact spring; a pivoting electrical contact wire; a pivoting catch arm; a pivoting catch arm pivot pin; a pivoting catch arm stop pin; a bimetal strip; a bimetal strip extension bracket; a bimetal strip pivot point; bimetal strip spring; a bimetal strip electrical bridge; a circuit board; a load wire input; a neutral wire input; a circuit breaker solenoid; a circuit breaker solenoid extension bracket; a load wire output; a neutral wire output; said load wire exit terminal; and said neutral wire exit terminal, wherein, said automatic house vent circuit breaker has a rigid hollow casing with a front surface, a rear surface, an upper surface, a lower surface, a right surface, and a left surface, said load wire input terminal is an electrical terminal or electrical connector that is made from conductive material that is located at the intersection of said rear surface and said right surface of said automatic house vent circuit breaker, said neutral wire input terminal is an electrical terminal or electrical connector that is located on said rear surface of said automatic house vent circuit breaker, said circuit breaker switch is a rigid oblong member with a first end, a middle section, and a second end, said circuit breaker switch is located on said front surface of said automatic house vent circuit breaker, said middle section of said circuit breaker switch is pivotally attached to said circuit breaker switch pivot pin, said circuit breaker switch pivot pin is a rigid vertical cylindrical member with a first end that is attached to said upper surface and a second end that is attached to said lower surface of said automatic house vent circuit breaker, said circuit breaker switch pivots about said circuit breaker switch pivot pin, said first end of said circuit breaker switch protrudes through said front surface of said automatic house vent circuit breaker, said first end of circuit breaker switch has a circuit closed position, a circuit open position, and a circuit tripped position, said pivoting electrical contact is a rigid oblong member with a first end, a middle section, and a second end, said pivoting electrical contact is made from conductive material, said first end of said pivoting electrical contact is pivotally attached to said second end of said circuit breaker switch at said pivoting electrical contact pivot point, said pivoting electrical contact pivots about said pivoting electrical contact pivot point, said pivoting catch arm is a rigid U-shaped member wherein the open end of said rigid U-shaped member faces said rear surface of said automatic house vent circuit breaker, said pivoting catch arm has a first end, a middle section, and a second end, said pivoting catch arm pivot pin is a rigid vertical cylindrical member with a first end that is attached to said upper surface and a second end that is attached to said lower surface of said automatic house vent circuit breaker, said first end of said pivoting catch arm is pivotally attached to said pivoting catch arm pivot pin, said pivoting catch arm pivots about said pivoting catch arm pivot pin, said pivoting electrical contact spring is a spring with a first end and a second end, said first end of said pivoting electrical contact spring is attached to said middle section of said pivoting catch arm, said second end of said pivoting electrical contact spring is attached to said middle section of said pivoting electrical contact, said pivoting electrical contact wire is an electrical wire with a first end and a second end and electrical continuity therebetween, said first end of said pivoting electrical contact wire is connected to said middle section of said pivoting electrical contact so that there is electrical continuity between these members, said bimetal strip is an oblong member with a first end, a middle section, and a second end, said second end of said pivoting electrical contact wire is connected to said second end of said bimetal strip so that there is electrical continuity between these members, said bimetal strip electrical bridge is a rigid oblong member with a first end and a second end, said bimetal strip electrical bridge is made from electrically conductive material, said first end of said bimetal strip electrical bridge is connected to said first end of said bimetal strip so that there is electrical continuity between these members, said first end of said bimetal strip electrical bridge is connected to said first end of bimetal strip at said bimetal strip pivot point, said bimetal strip is conductive, said bimetal strip is a bimetallic strip that consists of two strips of different metals that expand at different rates, said first end of said bimetal strip is rigidly attached to said front surface of said automatic house vent circuit breaker at said bimetal strip pivot point, said second end of said bimetal strip pivots about said first end of said bimetal strip at said bimetal strip pivot point, said bimetal strip spring is a spring with a first end and a second end, said first end of said bimetal strip spring is attached to said front surface of said automatic house vent circuit breaker, said second end of said bimetal strip spring is attached to said middle section of said bimetal strip, said middle section of said bimetal strip has a notch or an aperture that catches and holds said second end of said pivoting catch arm within said notch or aperture, said load wire input is an electrical wire with a first end and a second end and electrical continuity therebetween, said first end of said load wire input to circuit board is connected to said second end of said bimetal strip electrical bridge so that there is electrical continuity between these members, said second end of said load wire input is connected to said circuit board so that there is electrical continuity between these members, said neutral wire input is an electrical wire with a first end and a second end and electrical continuity therebetween, said first end of said neutral wire input is connected to said neutral wire input terminal so that there is electrical continuity between these members, said second end of said neutral wire input is connected to said circuit board so that there is electrical continuity between these members, said circuit board is a printed circuit board that supports and electrically connects electronic or electrical components attached to said circuit board, said load wire exit terminal is an electrical terminal or electrical connector that is made from conductive material, said load wire exit terminal is located on said left surface of said automatic house vent circuit breaker, said neutral wire exit terminal is an electrical terminal or electrical connector that is made from conductive material, said neutral wire exit terminal is located on said left surface of said automatic house vent circuit breaker, said load wire output is an electrical wire with a first end and a second end and electrical continuity therebetween, said first end of said load wire output is connected to said circuit board so that there is electrical continuity between these members, said second end of said load wire output is connected to said load wire exit terminal so that there is electrical continuity between these members, said neutral wire output is an electrical wire with a first end and a second end and electrical continuity therebetween, said first end of neutral wire output is connected to said circuit board so that there is electrical continuity between these members, said second end of neutral wire output is connected to said neutral wire exit terminal so that there is electrical continuity between these members, said circuit breaker solenoid is an electromechanical solenoid comprising: a circuit breaker solenoid inductive coil, a circuit breaker solenoid armature, and a circuit breaker solenoid extension bracket, said circuit breaker solenoid inductive coil is a cylindrical coil of metallic conductive wire with a first end, a second end, an interior, and a longitudinal axis, said first and second ends of said circuit breaker solenoid inductive coil are each attached to said circuit board so that there is electrical continuity between these members, said circuit breaker solenoid armature is a rigid cylindrical member with a first end, a second end, and a longitudinal axis, said circuit breaker solenoid armature is made of conductive material, said circuit breaker solenoid armature is slideably attached to said interior of said circuit breaker solenoid inductive coil with said longitudinal axis of said circuit breaker solenoid armature parallel to said longitudinal axis of said circuit breaker solenoid inductive coil, said first end of said circuit breaker solenoid armature is located in said interior of said circuit breaker solenoid inductive coil, said second end of said circuit breaker solenoid armature protrudes out of said second end of said circuit breaker solenoid inductive coil, said bimetal strip extension bracket is an oblong rigid bracket member with a first end and a second end, said circuit breaker solenoid extension bracket is an oblong rigid bracket member with a first end and a second end, said first end of said bimetal strip extension bracket is rigidly attached to said second end of bimetal strip, said second end of said bimetal strip extension bracket is slideably attached to said second end of said circuit breaker solenoid extension bracket, said first end of said circuit breaker solenoid extension bracket is attached to said second end of said circuit breaker solenoid armature, and said bimetal strip extension bracket is linked to said circuit breaker solenoid extension bracket which is linked to said circuit breaker solenoid armature.

10. An automatic house vent as recited in claim 9 further comprising: a load bridge wire and a neutral bridge wire, wherein, said load bridge wire is an electrical wire with a first end and a second end and electrical continuity therebetween, said first end of said load bridge wire is connected to said second end of said bimetal strip electrical bridge so that there is electrical continuity between these members, said second end of said load bridge wire is connected to said load wire exit terminal so that there is electrical continuity between these members, said neutral bridge wire is an electrical wire with a first end and a second end and electrical continuity therebetween, said first end of said neutral bridge wire is connected to said neutral wire input terminal so that there is electrical continuity between these members, and said second end of said neutral bridge wire is connected to said neutral wire exit terminal so that there is electrical continuity between these members.

11. An automatic house vent as recited in claim 10 further comprising: a ground fault sensor and at least one integrated circuit or chip, wherein, each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said ground fault sensor is a ground fault electrical sensor that functions to simultaneously monitor an electrical current flowing along said load bridge wire and an electrical current flowing along said neutral bridge wire, and detect when there is disequilibrium between said current flowing along said load bridge wire and said electrical current flowing along said neutral bridge wire and then sets off an alarm signal when this occurs, said ground fault sensor is attached to said circuit board with electrical continuity between these members, said load bridge wire physically passes through said ground fault sensor so that said ground fault sensor is configured to monitor the electrical current passing through said load bridge wire, and said neutral bridge wire also physically passes through said ground fault sensor so that said ground fault sensor is configured to monitor the electrical current passing through said neutral bridge wire.

12. An automatic house vent as recited in claim 10 further comprising: an arc fault sensor and at least one integrated circuit or chip, wherein, each said at least one integrated circuit or chip comprises an integrated circuit, a monolithic integrated circuit, an electronic chip, or a microchip, said at least one integrated circuit or chip is attached or connected to said circuit board so that there is electrical continuity therebetween, said at least one integrated circuit or chip has electrical continuity with said first and second ends of said circuit breaker solenoid inductive coil, said arc fault sensor is an arc fault electrical sensor that functions to monitor the electrical current flowing along said load bridge wire and detect when there is an electrical signal or an oscilloscope reading from the electrical current flowing along said load bridge wire that results from an arc fault or electrical short and then sets off an alarm signal when an arc fault or electrical short occurs, said arc fault sensor is attached to said circuit board with electrical continuity between these members, and said load bridge wire physically passes through said arc fault sensor so that said arc fault sensor is configured to monitor the electrical current passing through said load bridge wire.

* * * * *